US007111332B1

(12) United States Patent
Hsia

(10) Patent No.: US 7,111,332 B1
(45) Date of Patent: Sep. 26, 2006

(54) WATERLESS URINALS WHICH CAN BE FLUSHED

(76) Inventor: Chih-Yu Hsia, 301 Warren Way, Arcadia, CA (US) 91007

( * ) Notice: Subject to any disclaimer, the term of this patent is extended or adjusted under 35 U.S.C. 154(b) by 0 days.

(21) Appl. No.: 11/396,788

(22) Filed: Apr. 3, 2006

(51) Int. Cl.
*E03D 5/016* (2006.01)

(52) U.S. Cl. ..... 4/317; 4/318; 4/449; 210/167; 210/202

(58) Field of Classification Search ..... 4/317, 4/318, 321, 479–481, 471, 449, 462, 463, 4/459, DIG. 10, DIG. 19; 210/167, 192, 210/195.1, 202, 218, 259, 605, 622, 803
See application file for complete search history.

(56) References Cited

U.S. PATENT DOCUMENTS 3,673,614 A * 7/1972 Claunch ..... 4/317
4,014,767 A * 3/1977 Schmidt ..... 4/318
4,070,714 A * 1/1978 Bishton et al. ..... 4/318
4,346,002 A * 8/1982 Petzinger ..... 210/202
6,496,988 B1 * 12/2002 Hammond ..... 4/317

* cited by examiner

*Primary Examiner*—Tuan Nguyen

(57) ABSTRACT

A waterless urinal that can be flushed with liquid consists of a urinal with a flushing liquid and urine separator and a flushing liquid recycling system; the flushing liquid and urine separator having three flow barriers which can guide urine to down-and-up type flow paths to a drain; two of the three flow barriers being able to serve as weirs; the flushing liquid recycling system being able to send flushing liquid from the lower portion of the urinal to the upper portion of the urinal; the flushing liquid recycling system being optionally a foot-operated pumping system which optionally having a paddle which connects to a bucket which can be tilted up or down by operations of the paddle; the foot-operated pumping system of the flushing liquid recycling system optionally having two paddles; the flushing liquid recycling system optionally being a pump, motor and piping system which has sensors, timer and power control and supply system.

28 Claims, 32 Drawing Sheets

WATERLESS URINALS WHICH CAN BE FLUSHED

BACKGROUND OF THE INVENTION

1. Field of the Invention

This invention relates to urinals which are not connected with water sources but which can be flushed with self-contained liquid. The urinals have the ability to separate urine and the liquid. The urine can be drained but the liquid can be recycled to flush the urinals. The urinals can be flushed automatically after each use.

2. Descriptions of the Prior Arts

No prior art related to waterless urinals which can be flushed was found.

SUMMARY OF THE INVENTION

Common urinals take a lot of water to flush after each use. Commercially available waterless urinals can not be flushed. Therefore, urinal residuals can not be flushed off from the interior surfaces of these waterless urinals. These urinals cause health concerns. Urinals that not only can save water but also can be flushed after each use are sought.

The current invented devices do not use water but use recycled self-contained liquid to flush the urinals after each uses. The current invented devices also automatically flush themselves after each uses.

These and other objects and advantages of the invention, as well as the details of an illustrative embodiment, will be more fully understood from the following specification and drawings, in which:

DRAWING DESCRIPTION

GENERAL DESCRIPTION

Figure 1:
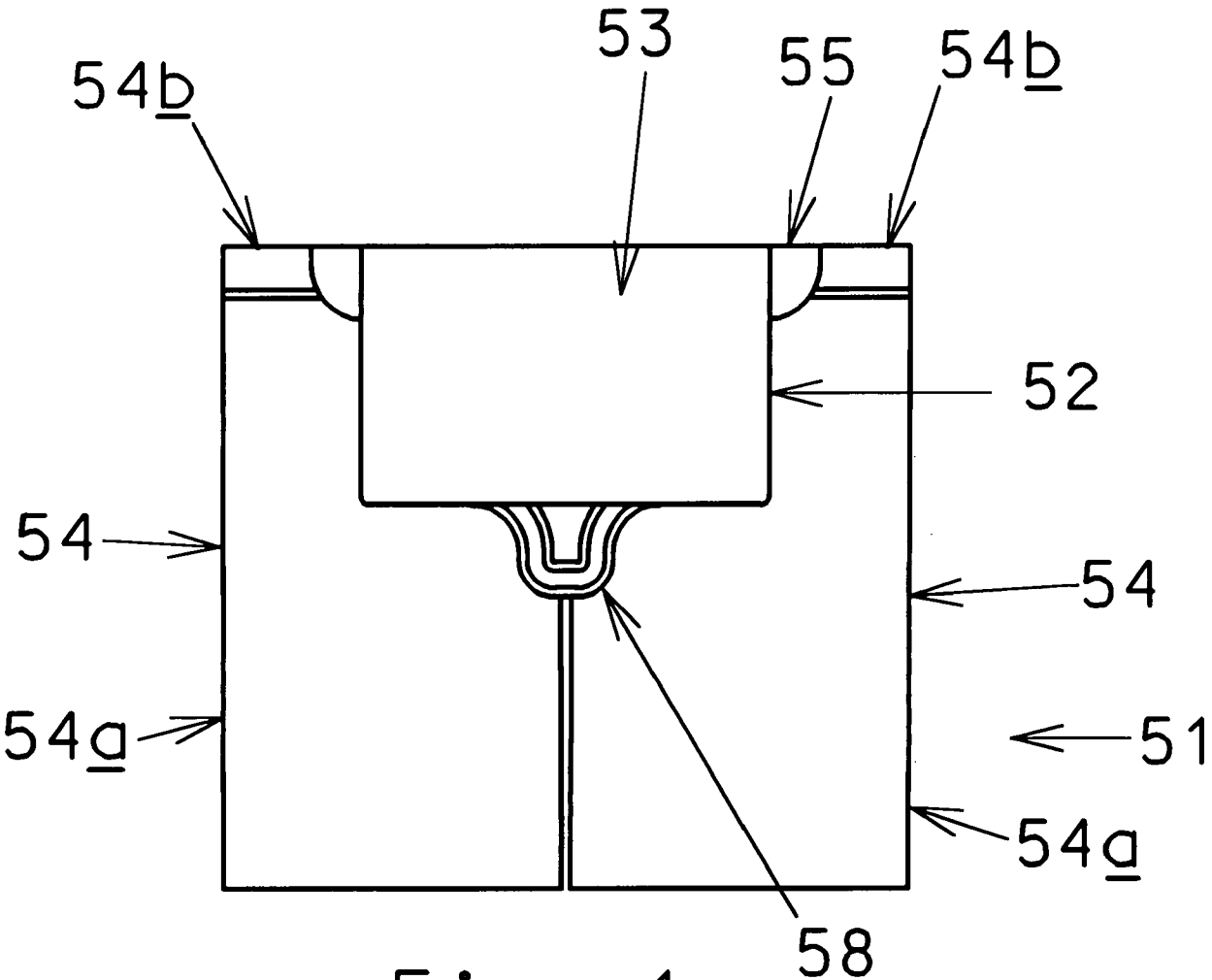
FIGS. 1, 2 and 3 are a top view, an elevation view and a side view, respectively, of one variation of the invented device. In these views, only visible lines are shown.
Figure 2:
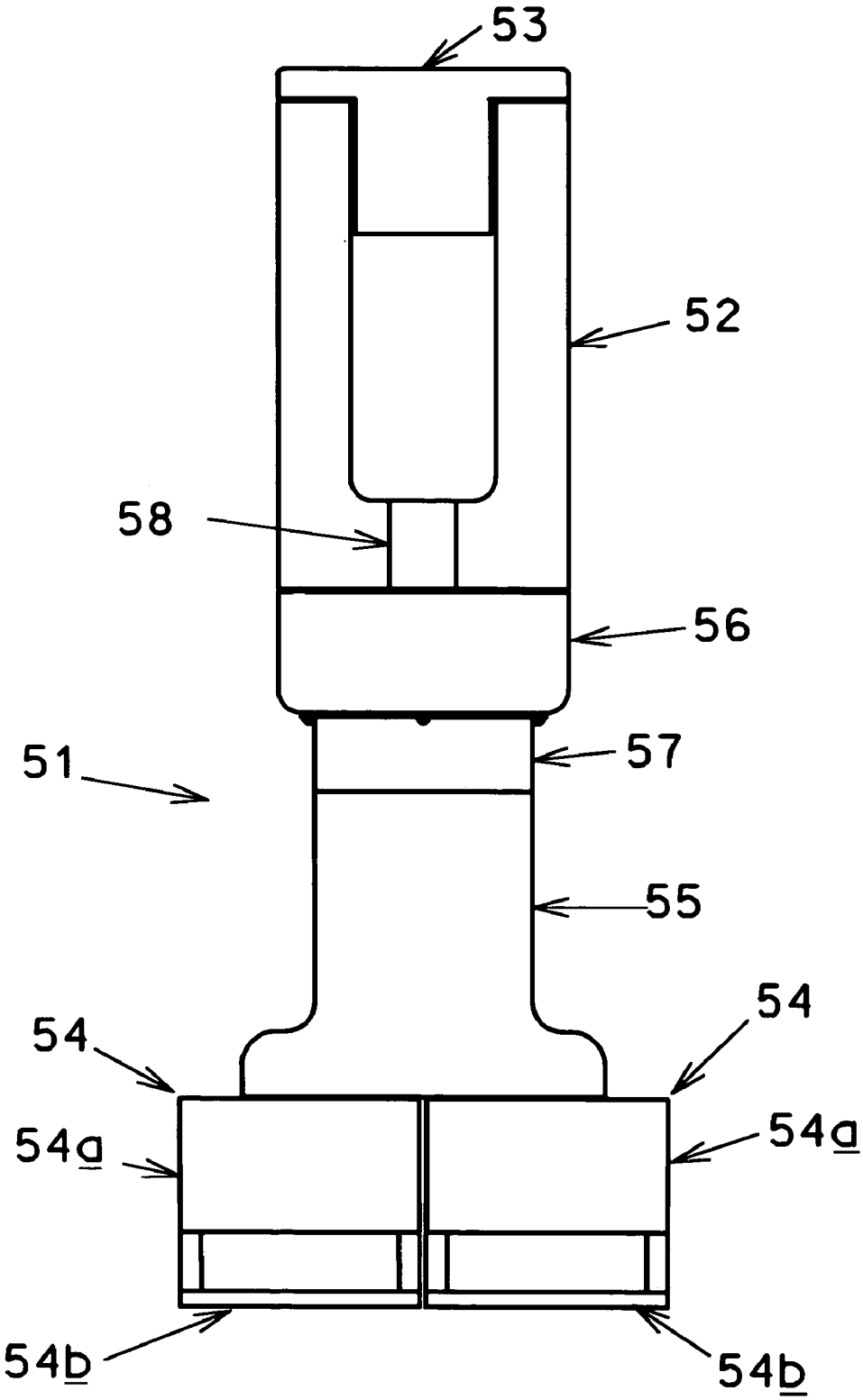
Figure 3:
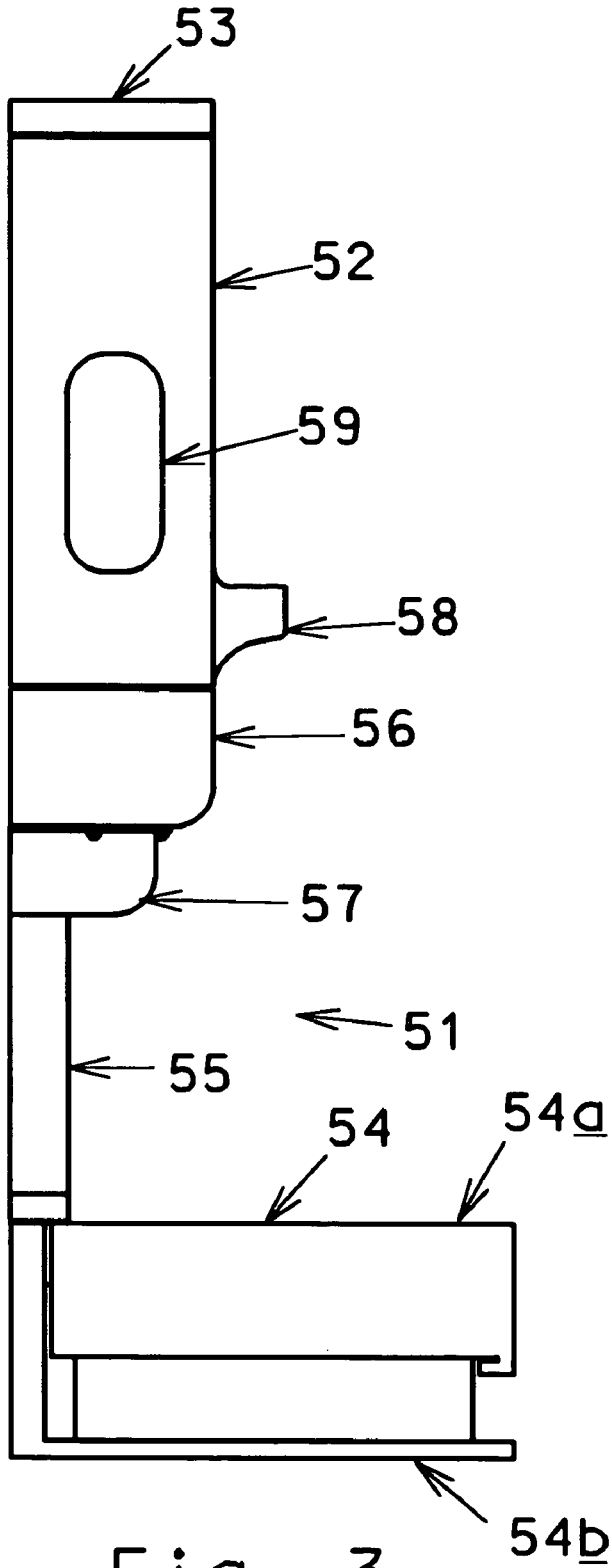
Figure 4:
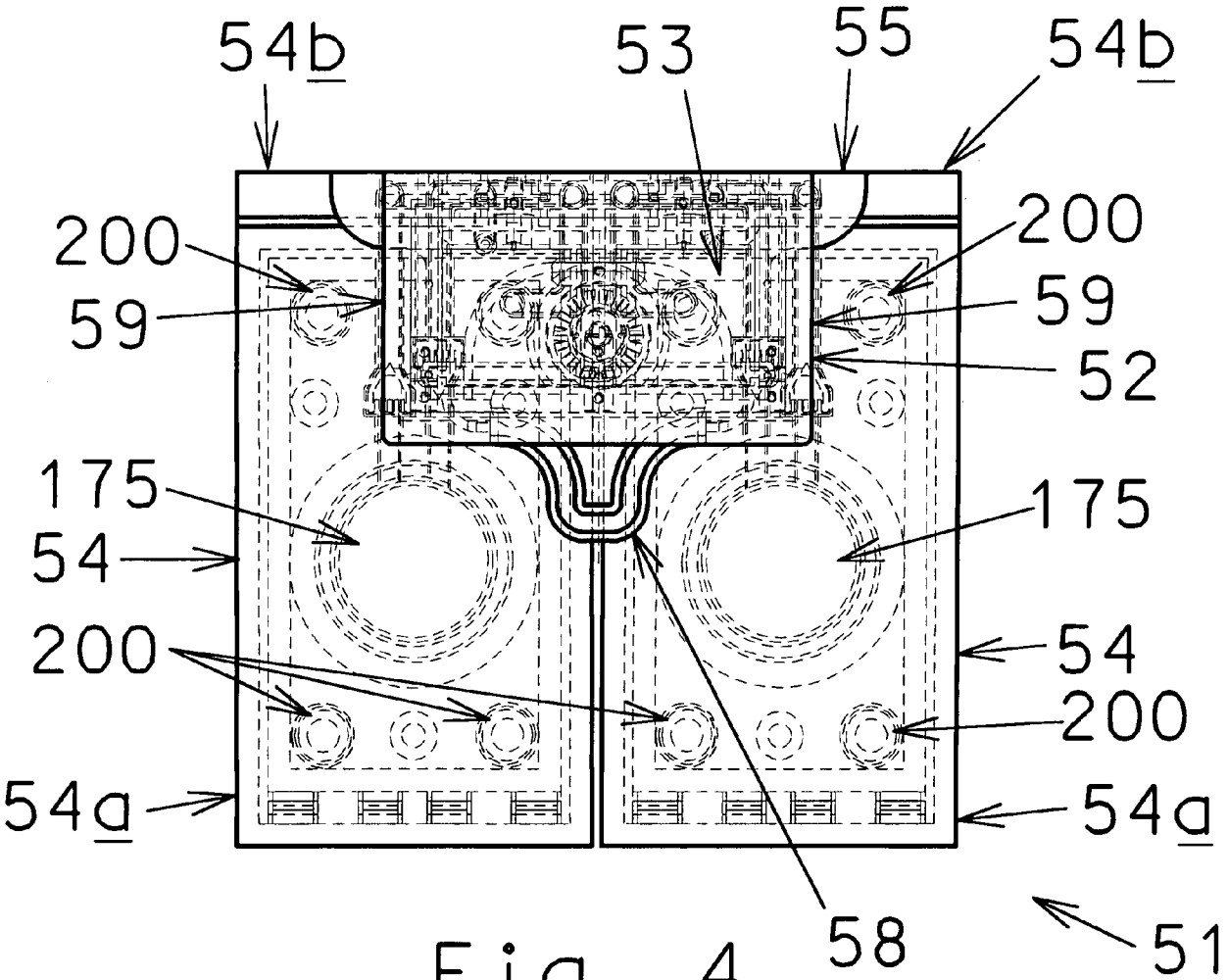
FIGS. 4, 5 and 6 are a top view, an elevation view and a side view, respectively, of the invented device shown in FIGS. 1, 2 and 3. In these views, all lines are shown.
Figure 5:
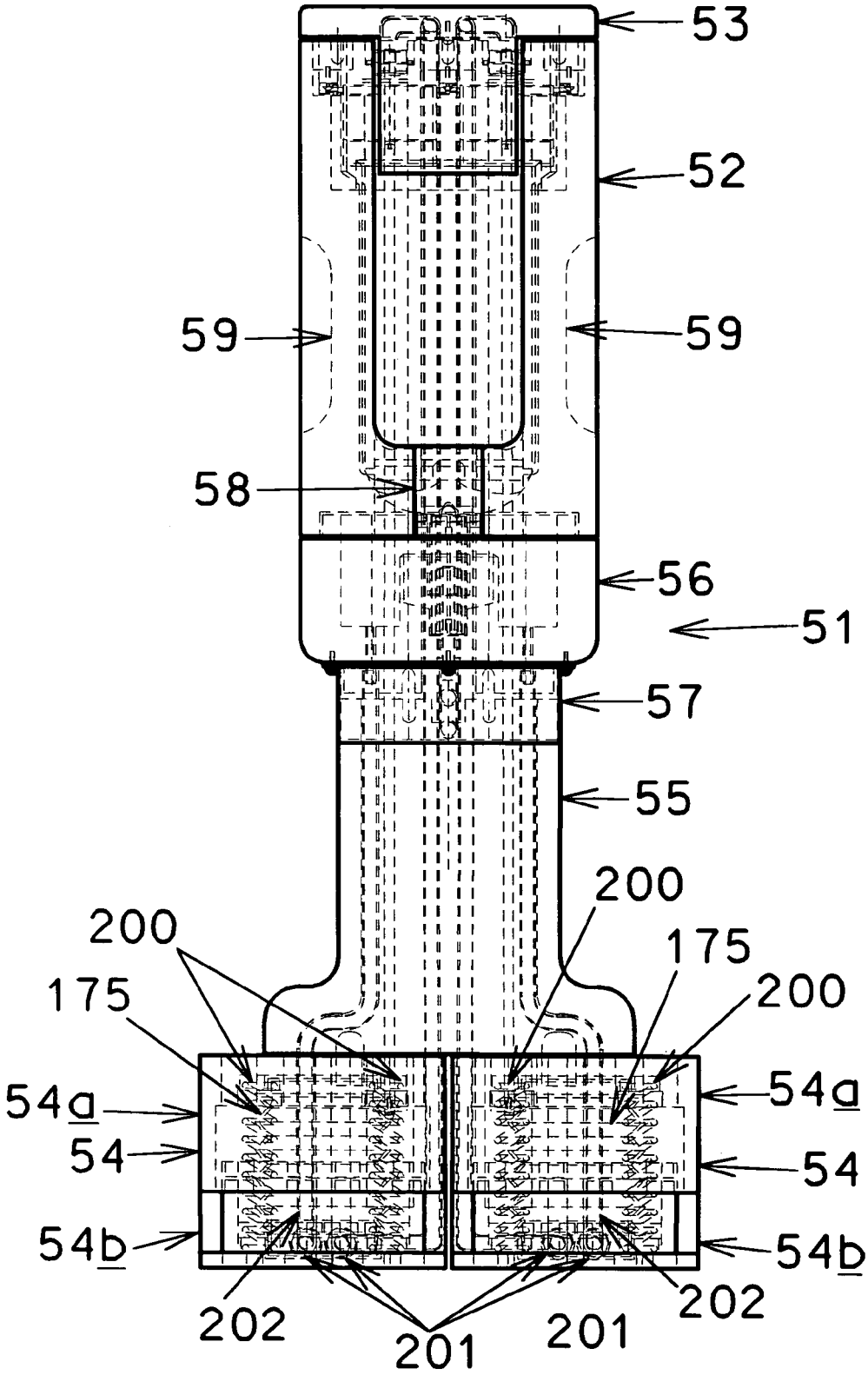
Figure 6:
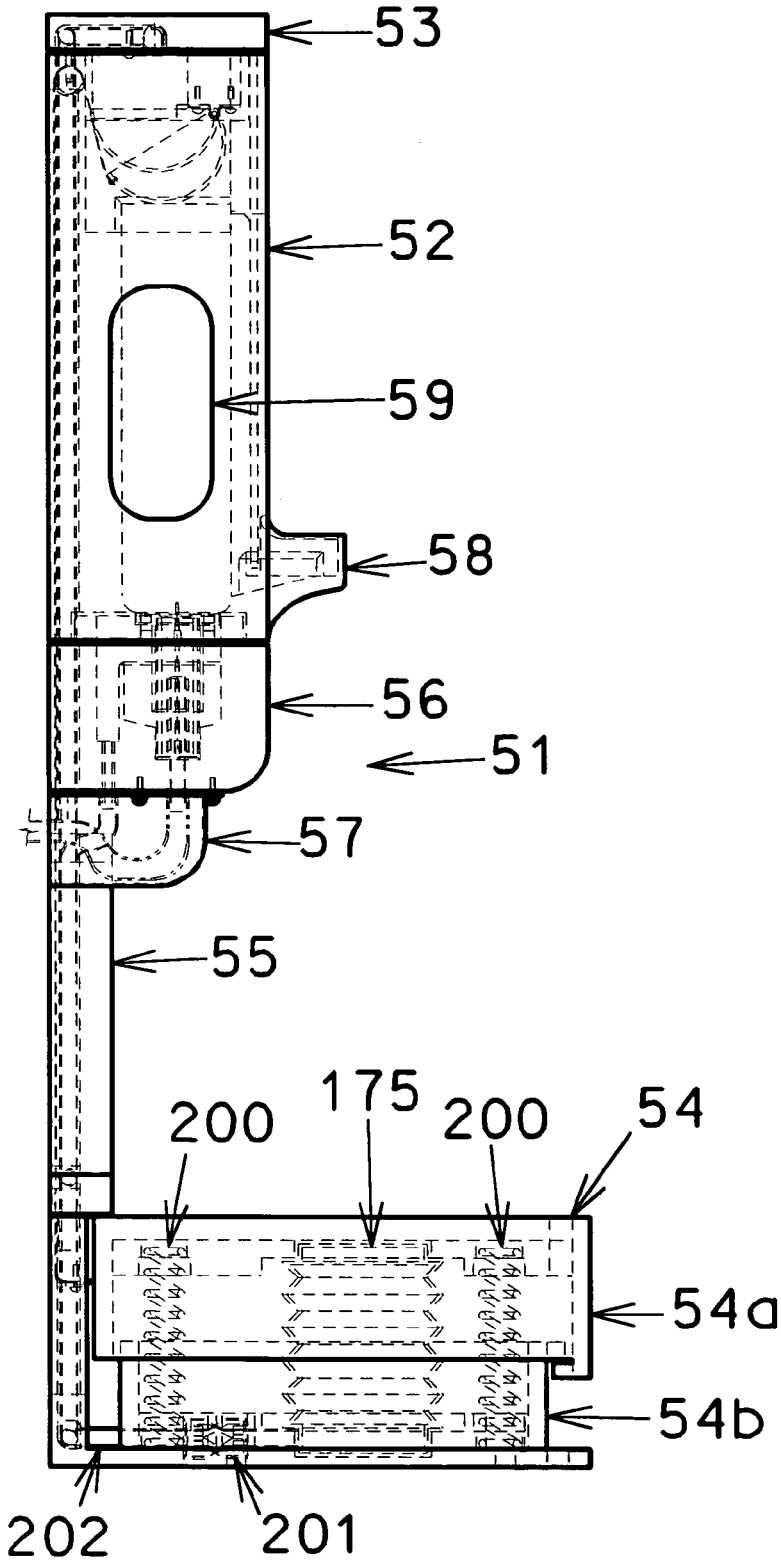

Two variations of the invented devices are introduced herein in this specification.

Referring to FIGS. 1 through 6, the first variation of the invented waterless urinals which can be flushed 51 consists of a body 52, a cover 53, a pair of foot pumps 54, a conduit cover 55, a receiving base 56, an existing drain cover 57, and two piping/control/holding systems (not identified but will be discussed later). Each of the foot pumps 54 has a foot pump top portion 54*a* and a foot pump bottom portion 54*b*.

Figure 7:
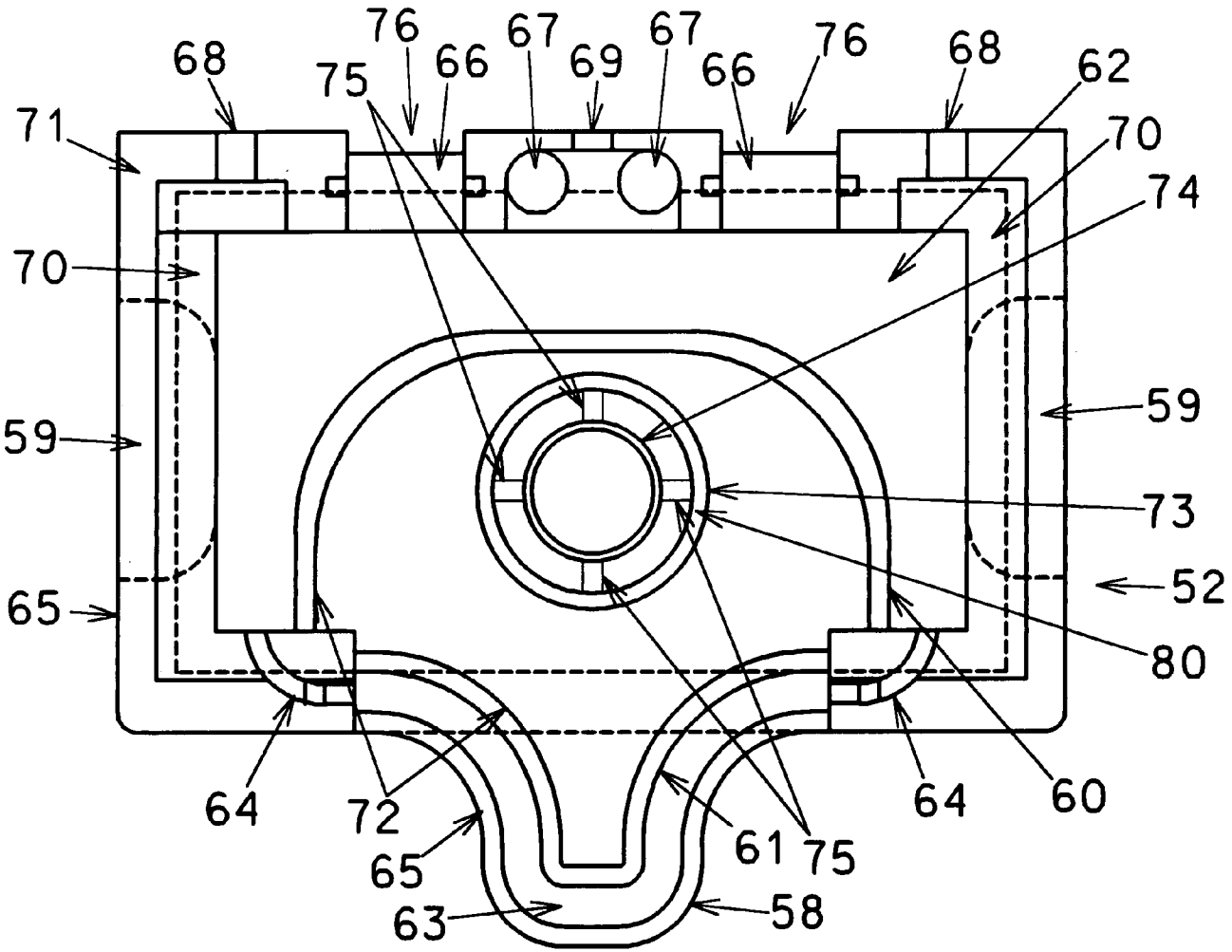
FIGS. 7, 8 and 9 are a top view, an elevation view and a side view, respectively, of the "body" component of the invented device.
Figure 8:
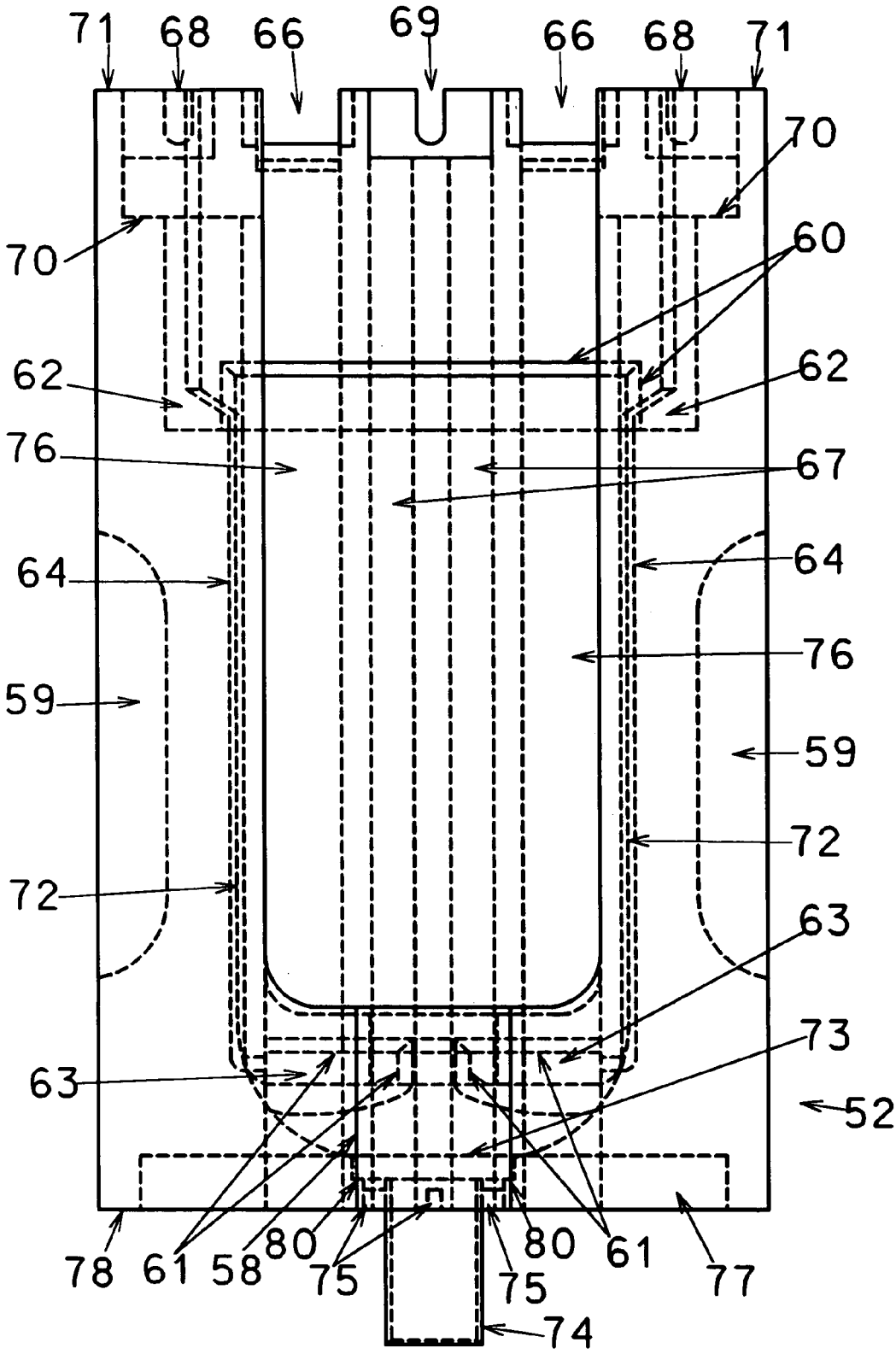
Figure 9:
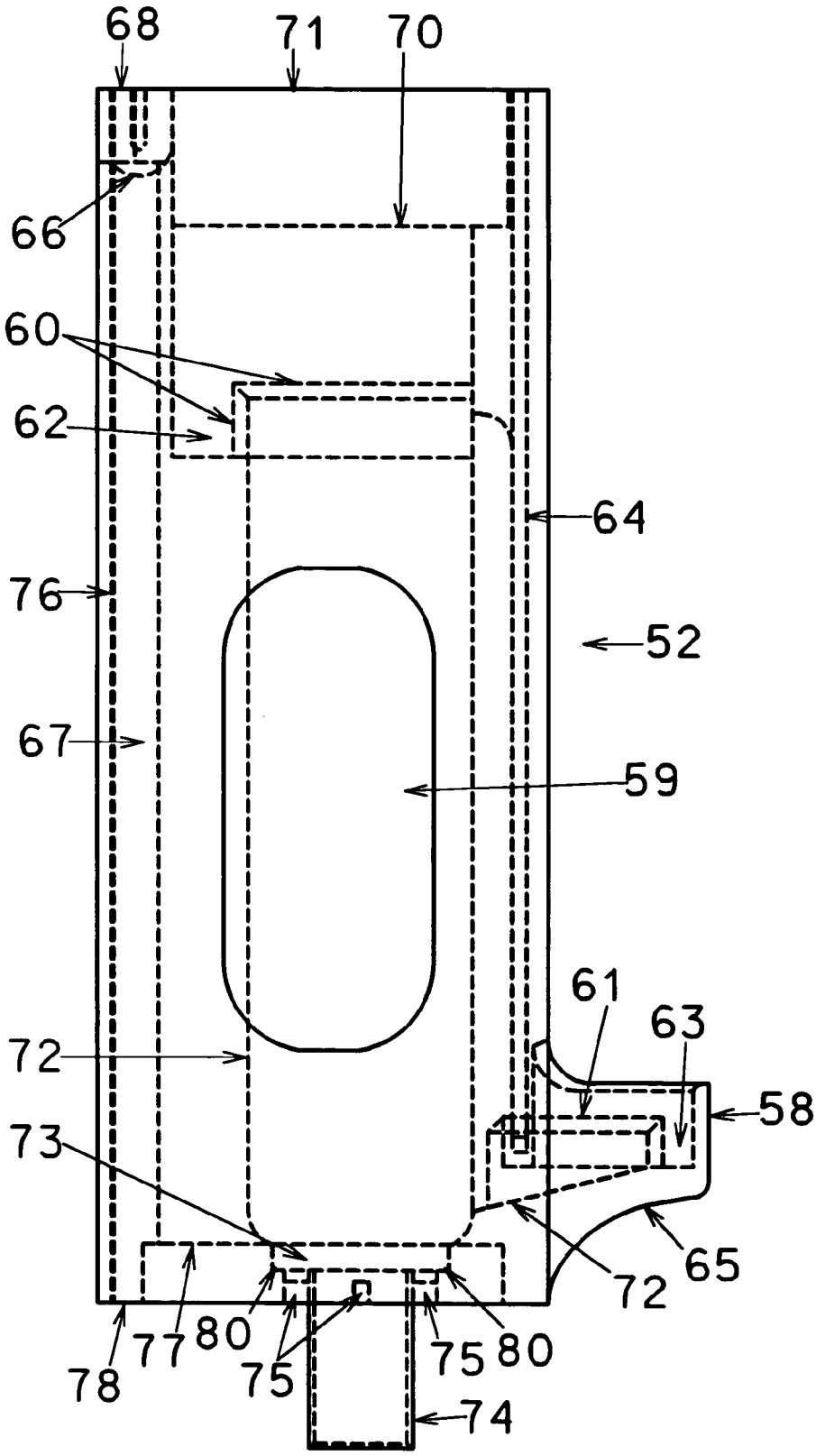

Referring to FIGS. 7, 8, and 9, the body 52 has a body protrusion 58, a pair of recessed hand holes 59, a high weir 60, a low weir 61, a high channel 62, a low channel 63, a pair of connection channels 64, outer walls 65, a pair of pulley hole 66, a pair of supply tube holes 67, several anchoring notches 68 and 69, a cover receiver recess 70, a cover supports 71, a flush wall 72, a drain hole 73, a urine separator curtain 74, several curtain supports 75, a couple belt rooms 76, a receiving base recess 77, a receiving base connection wall 78, a drain unit (not shown in FIGS. 7, 8 and 9 but will be discussed with FIGS. 16, 17, and 18 later), and a drain unit support 80. The body 52 basically is an open box that has an interior surface, mostly the flush wall 72, and the exterior wall, the outer wall 65. There are recessed areas, the recessed hand holes 59, on opposite sides of the exterior surfaces of the box. On the backside of the exterior wall of the box there are recessed areas and longitudinal holes, the belt rooms 76 and the supply tube holes 67, respectively. The topside and a portion of the front side of the box are open. There are slots, the anchoring notches 68 and 69, recessed areas, the cover receiver recess 70, protruding areas, the cover support 71, and areas for pulleys, the pulley hole 66, on the top rim of the box. There is a protruding portion, the body protrusion 58, below the opening on the front side of the box. There is a hole, the drain hole 73, on the bottom of the box. The interior wall of the box is mostly the flush wall 72 which is approximately vertical in most part and which has the drain hole 73 at the bottom. At the top end of the flush wall 72 is the high weir 60 which is a wall of the high channel 62 which is a depressed area behind the high weir 60. Along the interior side of the body protrusion 58 is the low channel 63 which is a depressed area next to the low weir 61 which is the extension of the flush wall 72 for the body protrusion 58 region. There is an opening at each end of the high channel 62 and the low channel 61. A conduit, the connection channel 64, connects the two openings. The urine separator curtain 74 is a conduit mounted by mounting means, the curtain supports 75, to the drain hole 73. The drain unit support 80 is a recessed shoulder of the drain hole 73. At the bottom end of the box there are recessed areas, the receiving base recess 77, and protruding areas, the receiving base connection wall 78.

Figure 10:
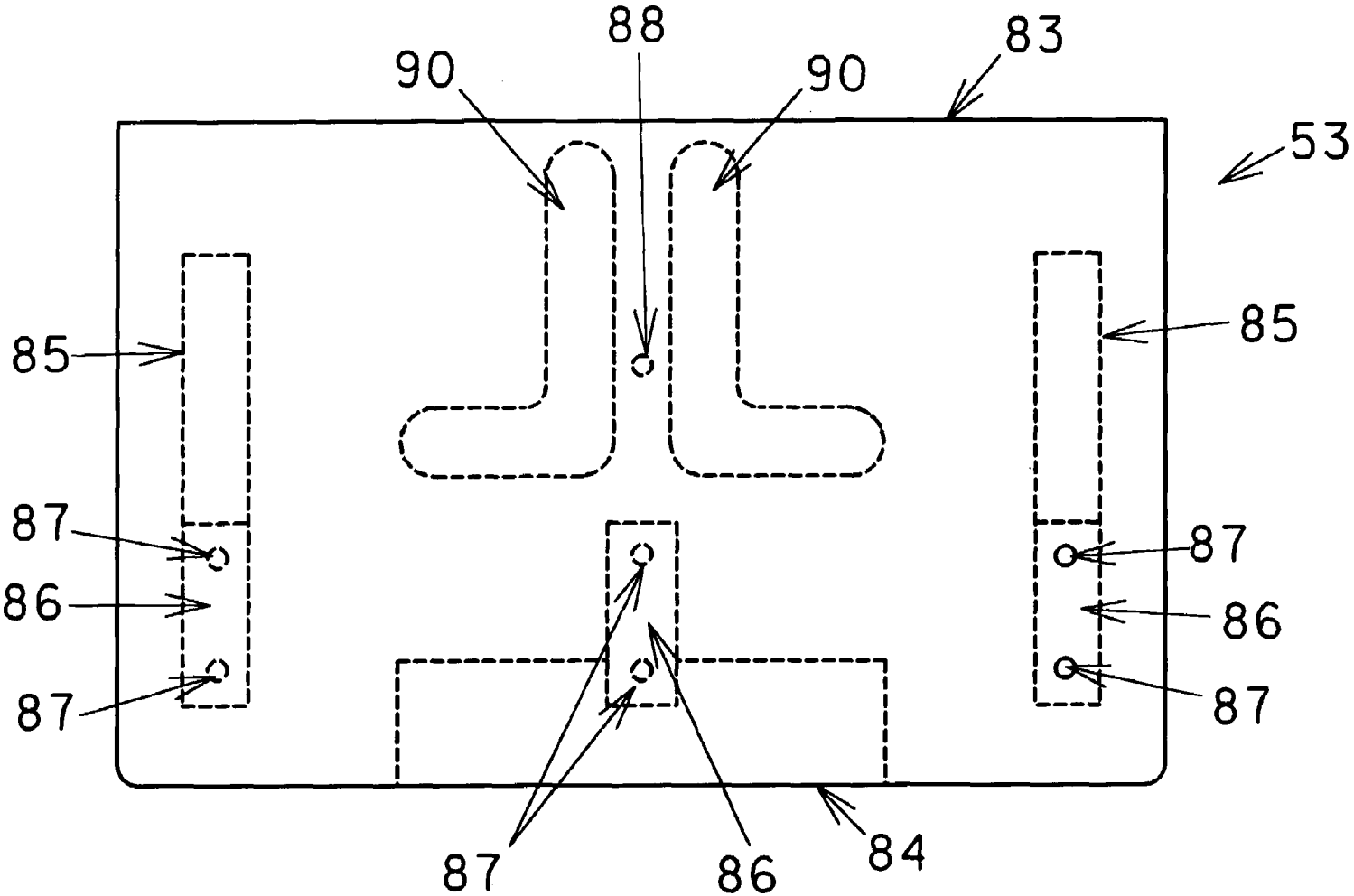
FIGS. 10, 11 and 12 are a top view, an elevation view and a side view, respectively, of the "cover" component of the invented device.
Figure 11:
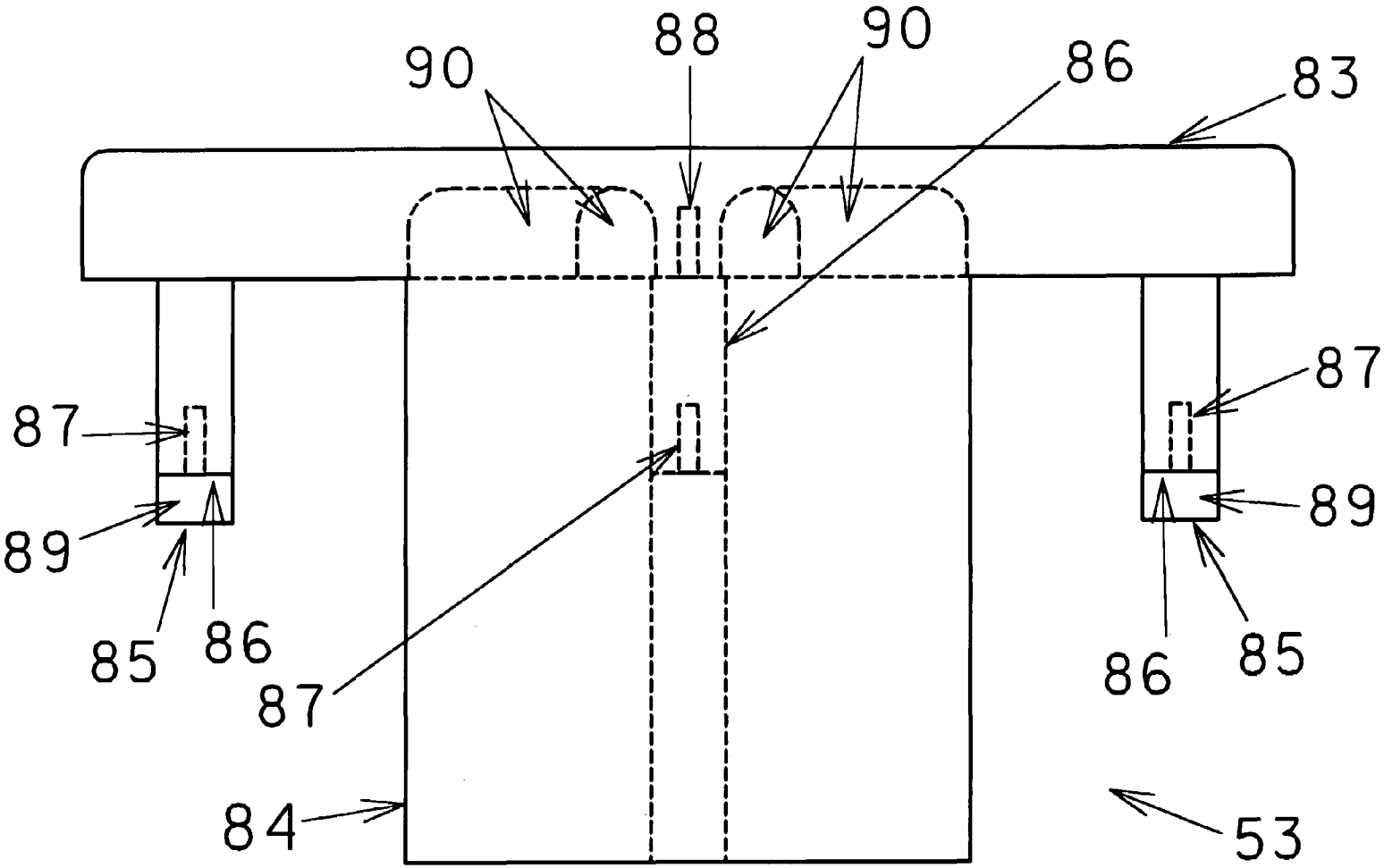
Figure 12:
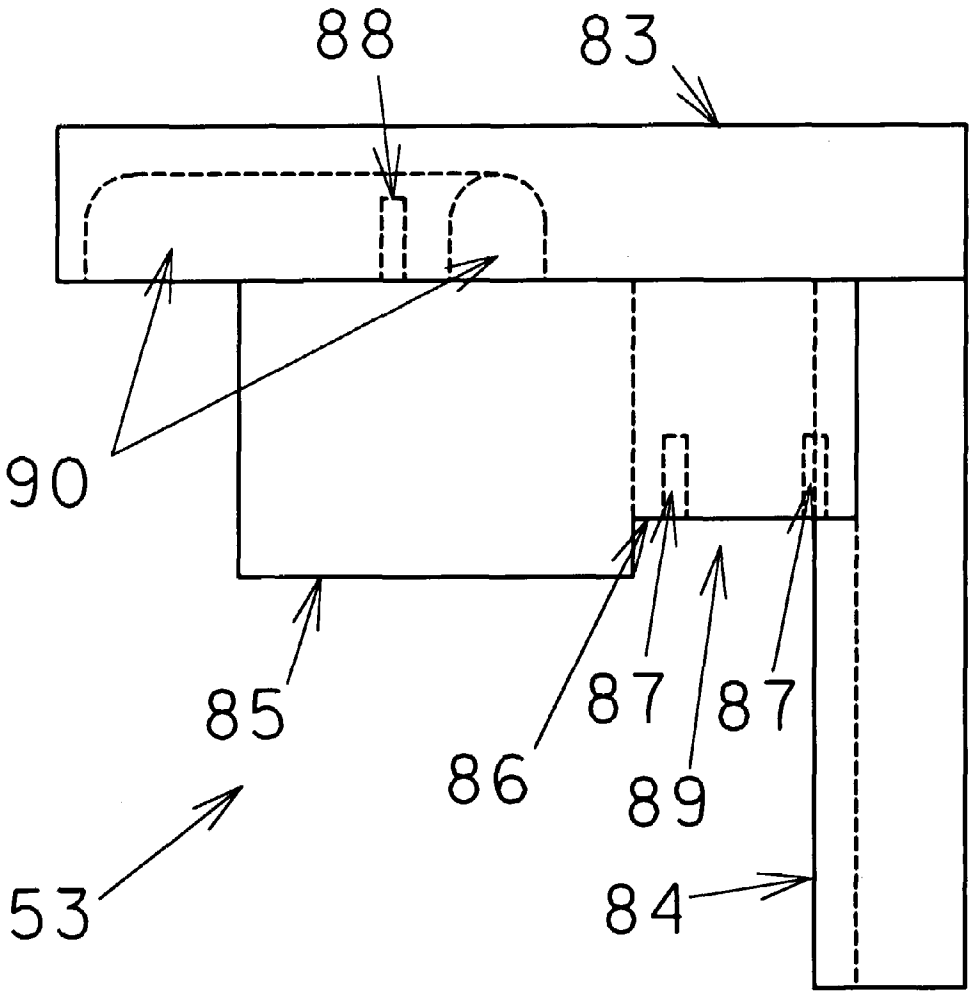

Referring to FIGS. 10, 11 and 12, the cover 53, a generally bent "L"-shaped plate, consists of a cover top 83, a cover front 84, a pair of cover support beams 85, three bucket mounting supports 86, many bucket mounting holes 87, a pair of supply tube channels 90, and a supply tube mounting hole 88. The cover top 83 and the cover front 84 are plates. The cover support beams 85 and the bucket mounting supports 86 are objects protruding from the bottom of the cover top 83. Two of the bucket mounting supports 86 are adjacent to the cover support beams 85. A recess in heights, the bucket mounting recess 89, distinguishes the cover support beam 85 and the bucket mounting support 86. The supply tube channels 90 are depressed channels under the cover top 83. The bucket mounting holes 87 and the supply tube mounting hole are holes for screws.

Figure 13:
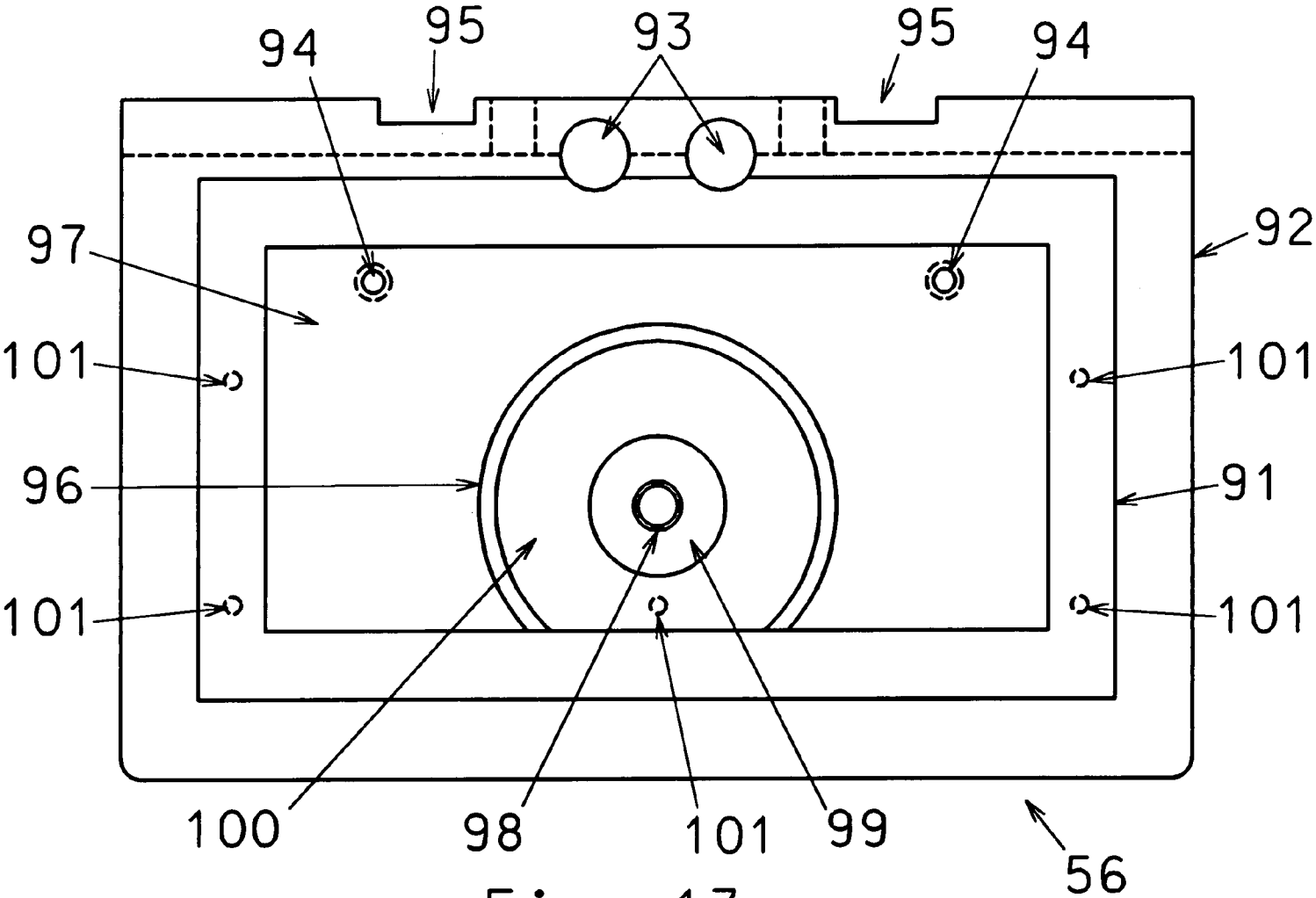
FIGS. 13, 14 and 15 are a top view, an elevation view and a side view, respectively, of the "receiving base" component of the invented device.
Figure 14:
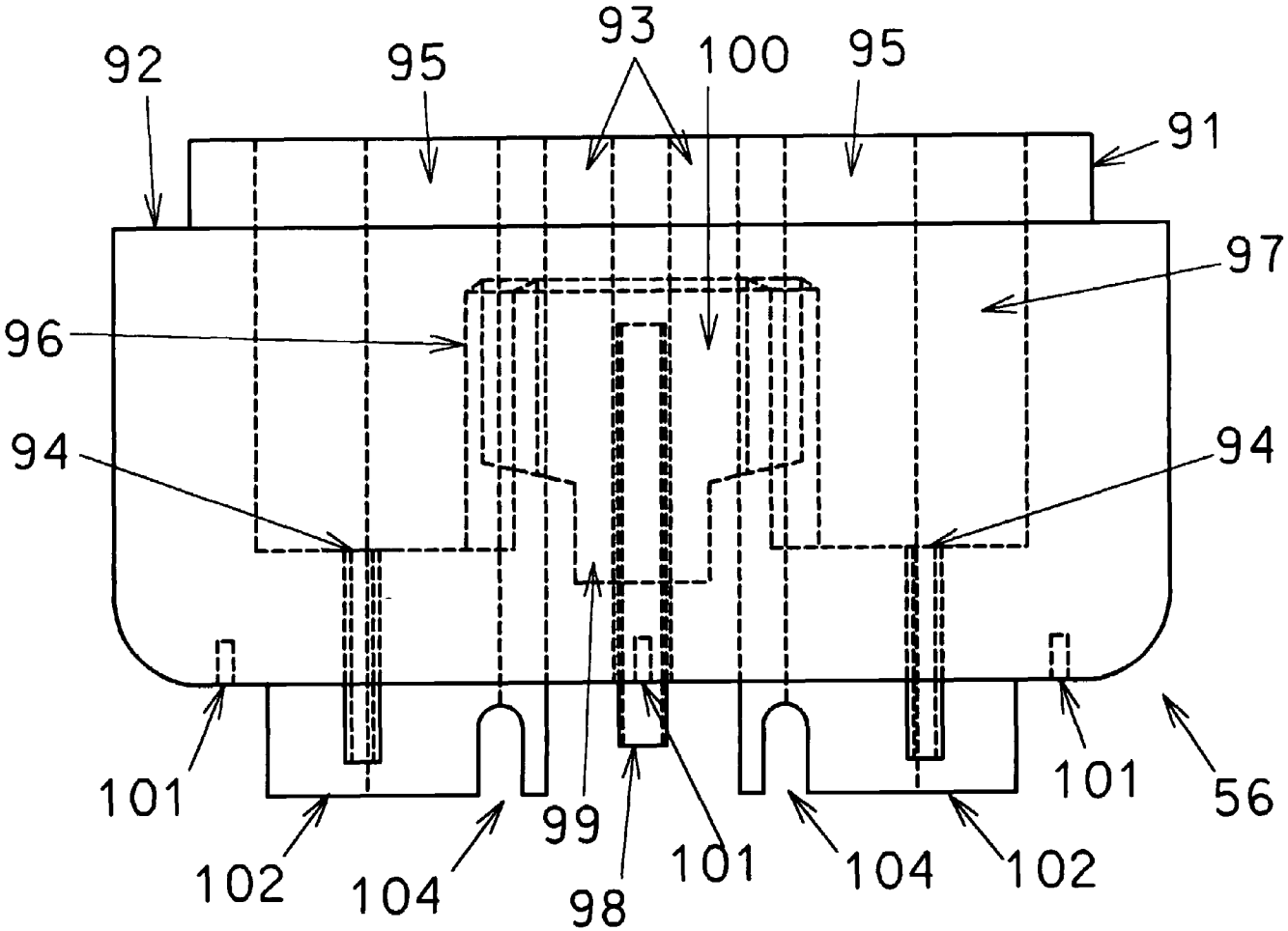
Figure 15:
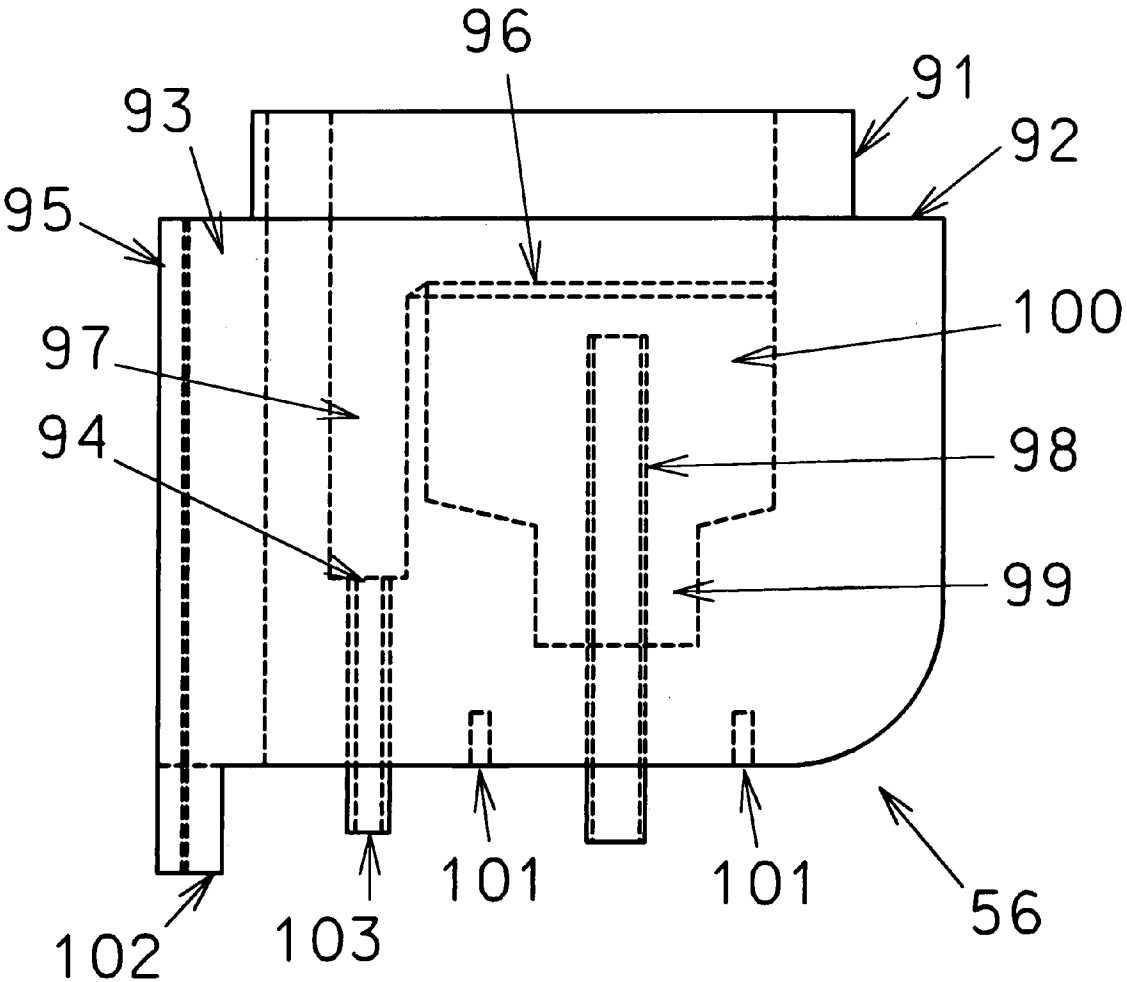

Referring to FIGS. 13, 14 and 15, the receiving base 56 basically is a basing which has protruding areas, the receiving base protrusion 91, and recessed areas, the body support 92, along the rim. The basin has three outlets, a urine outlet pipe 98 and two return tube drain holes 94. On the backside of the basin there are recessed areas, the belt rooms 95, and two holes, the supply tube holes 93. A relatively high wall, the flushing liquid controlling weir 96, protrudes vertically above the bottom of the basin and divide the basin into two distinguished chambers, the flushing liquid chamber 97 and the flushing liquid/urine chamber 100. The drain outlet pipe 98 is a vertical pipe protruding vertically inside the flushing liquid/urine chamber 100. A depressed area, the drain unit chamber 99, is inside the flushing liquid/urine chamber 100 and around the urine outlet pipe 98. The bottom of the flushing liquid/urine chamber 100 slopes towards the drain unit chamber 99. The top rim of the drain outlet pipe 98 is lower than the rim of the flushing liquid controlling weir 96. At the bottom of the basin there are many holes for screws, the existing drain cover mounting holes 101, and three pipes, the other side of the urine outlet pipe 98 and two return tube/drain pipe connections 103. The return tube/drain pipe connections 103 are pipes which connect with the return drain hole 94. At the bottom backside side of the basin there are protruding plates, the wall mounting plates 102, which has slots, the mounting slots 104, for mounting of the receiving base on a wall.

Figure 16:
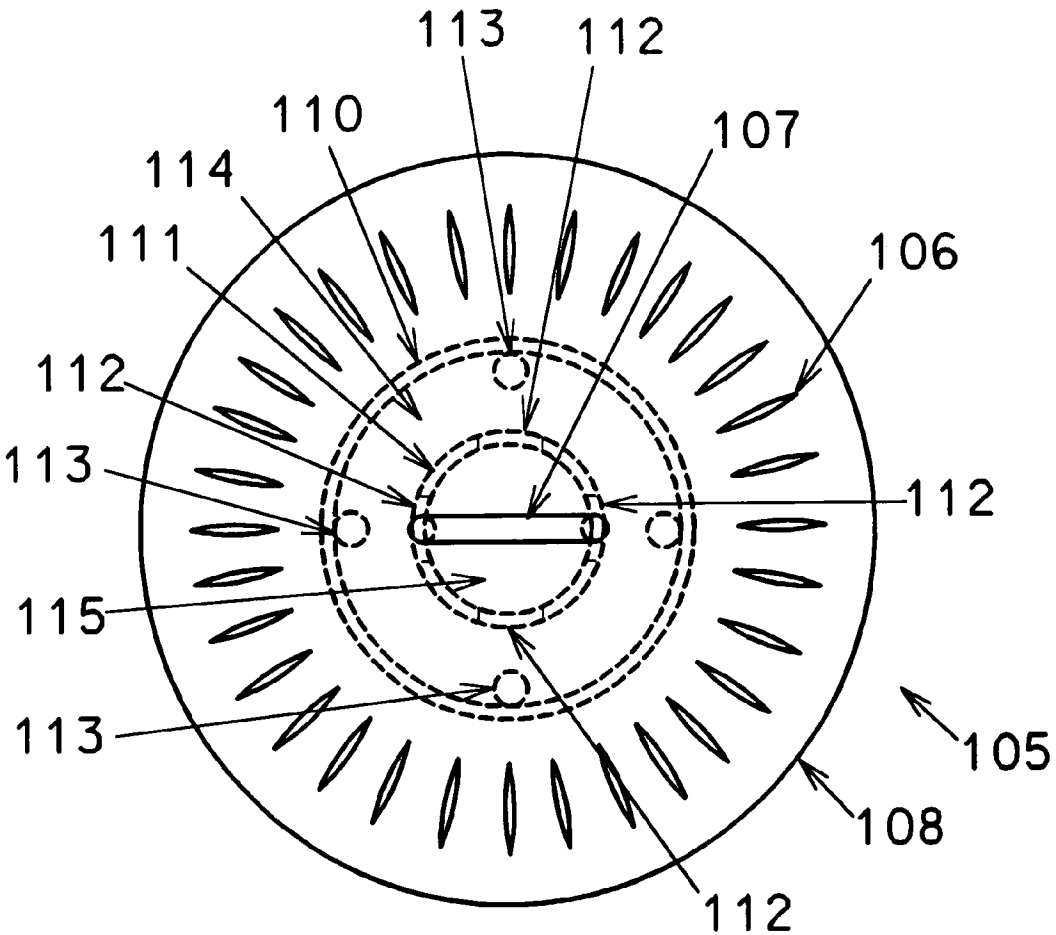
FIGS. 16, 17 and 18 are a top view, an elevation view and a side view, respectively, of the "drain unit" component of the invented device.
Figure 17:
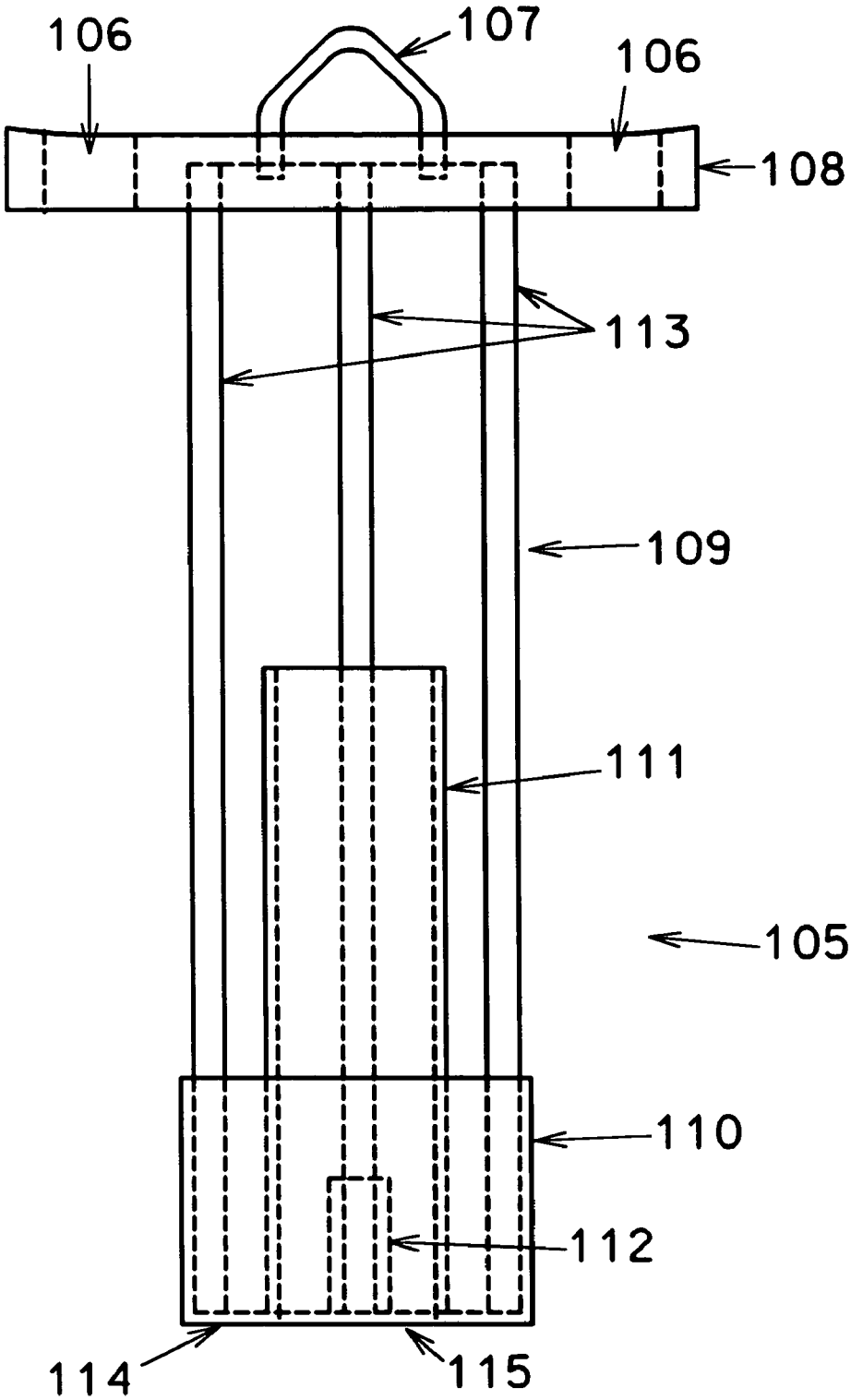
Figure 18:
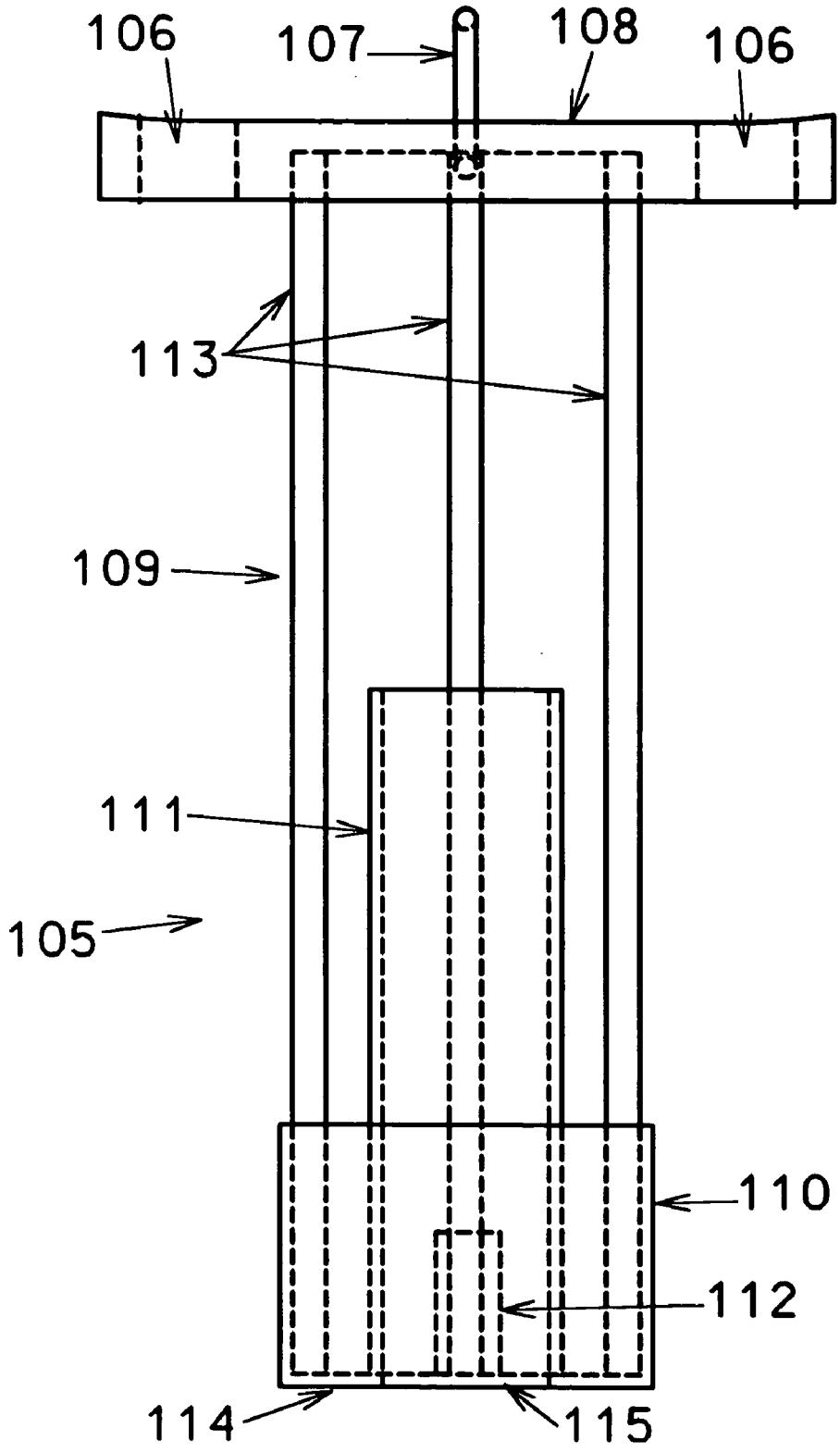

Referring to FIGS. 16, 17 and 18, the drain unit 105 consists of a top plate 108 and a debris basket 109. The top plate 108 is a plate with many perforation slots, the drain slot 106. An eye, the lifting eye 107, is on top of the top plate. The debris basket 109 consists of a debris basket outer wall 110, a debris basket inner wall 111, many debris basket drain slots 112, a debris basket bottom plate 114, and many debris basket mounting rods 113. The debris basket bottom plate 114 is a plate with a hole 115 in the center. The debris basket outer wall 110 and the debris basket inner wall 111 are short tubes which one end are connected with the rims of the debris basket bottom plate 114 and the hole 115, respectively. The debris basket drain slots 112 are openings on the debris basket inner wall 111 near the debris basket bottom plate 114. The debris basket mounting rods 113 are rods which one ends connect with the bottom of the top plate 108 and which the other ends connect with the debris basket outer wall 110. The debris basket outer wall can be fitted in the drain unit chamber 99 of the receiving base 56 (Referring to FIGS. 13, 14 and 15). The urine outlet pipe 98 can snugly penetrate the hole 115 of the debris basket bottom plate 114.

Referring to FIGS. 1, 2, 3, 4, 5 and 6, a foot pump 54 consists of a foot pump top portion 54*a*, a foot pump bottom portion 54*b*, a bellow 175, many springs 200, two check valves 201, and piping 202. The bellow, the springs, the check valves and the piping also belong to the piping/control/holding system which will be described later.

Figure 19:
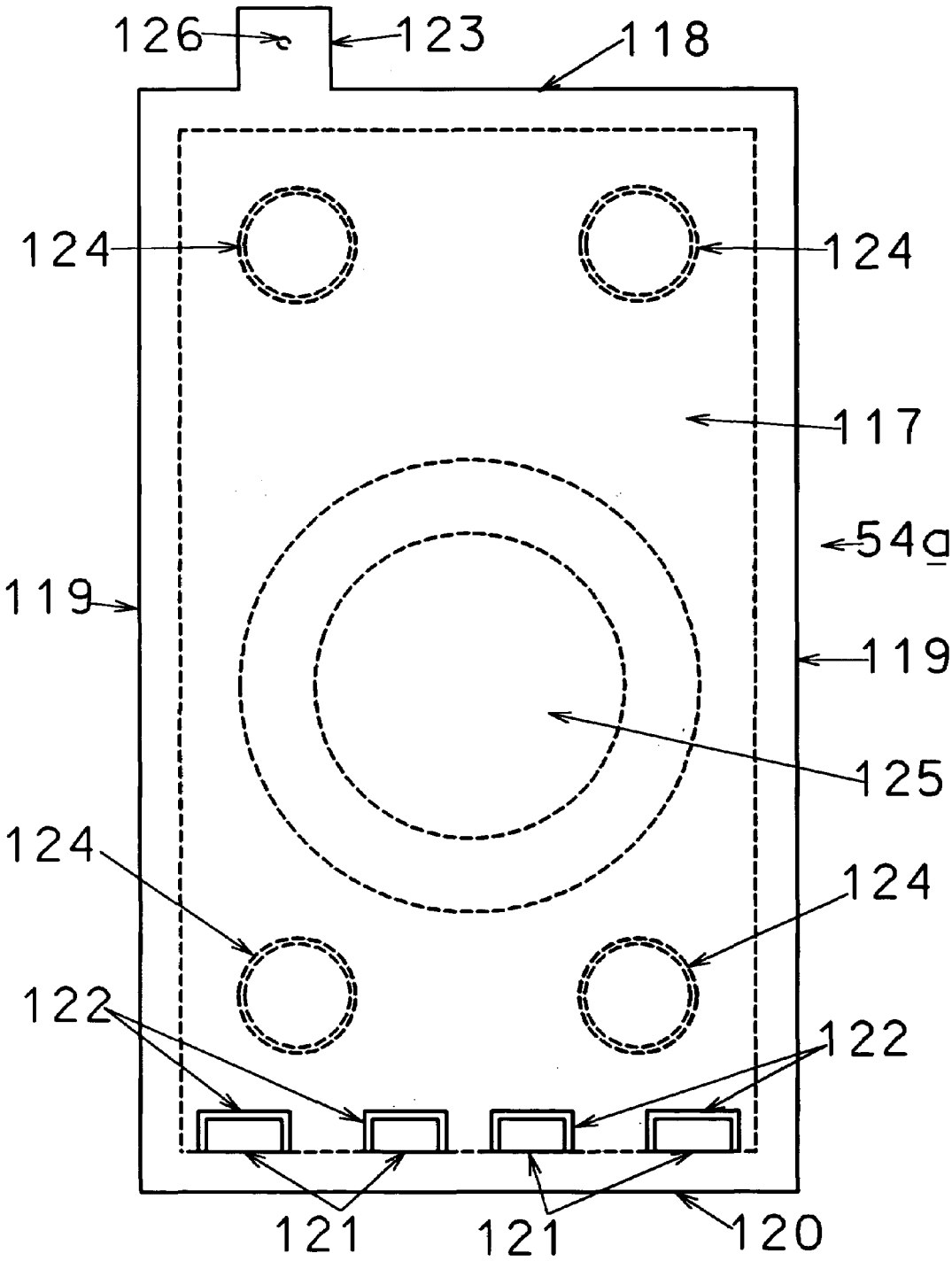
FIGS. 19, 20 and 21 are a top view, an elevation view and a side view, respectively, of the "foot pump top portion" component of the invented device.
Figure 20:
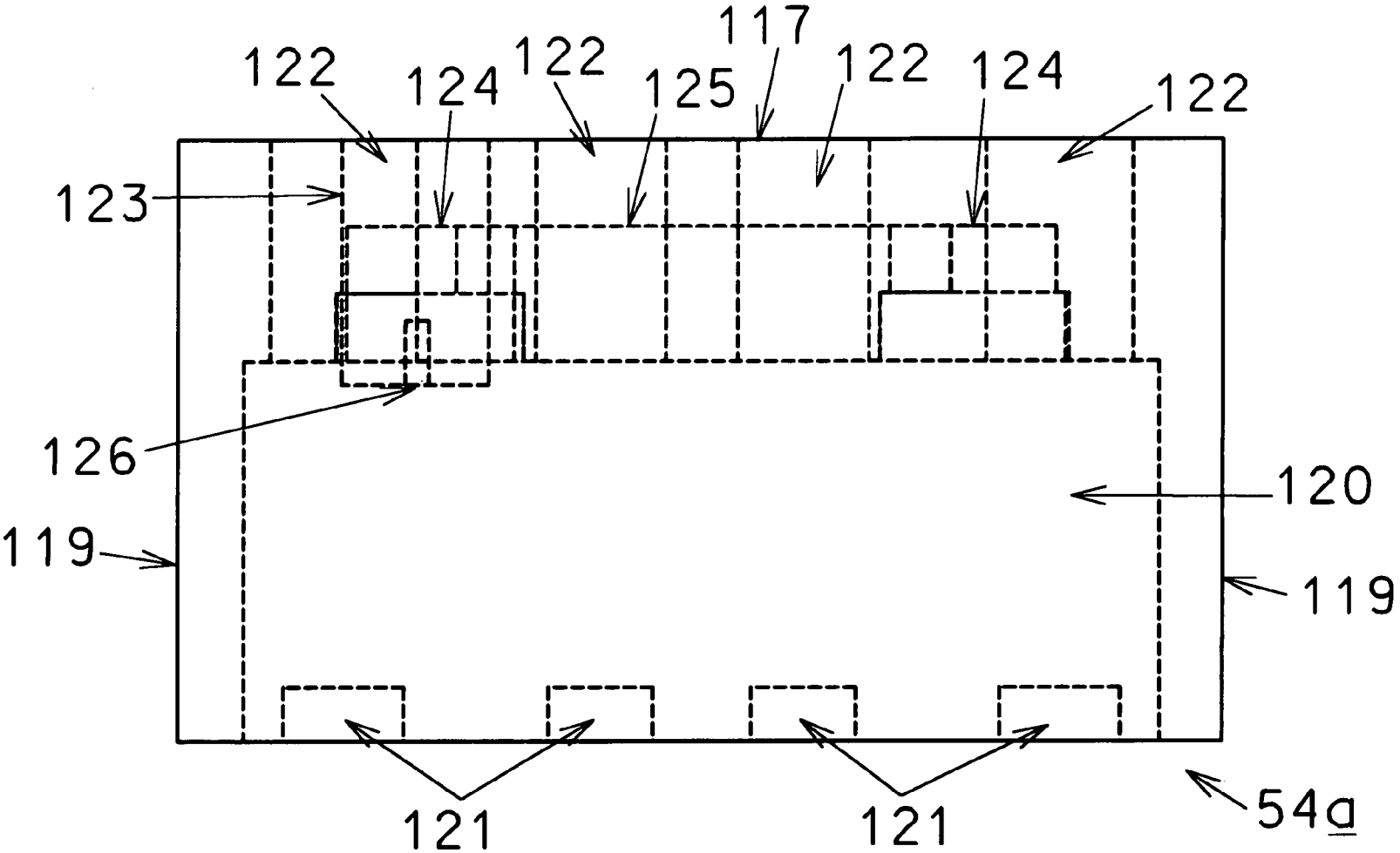
Figure 21:
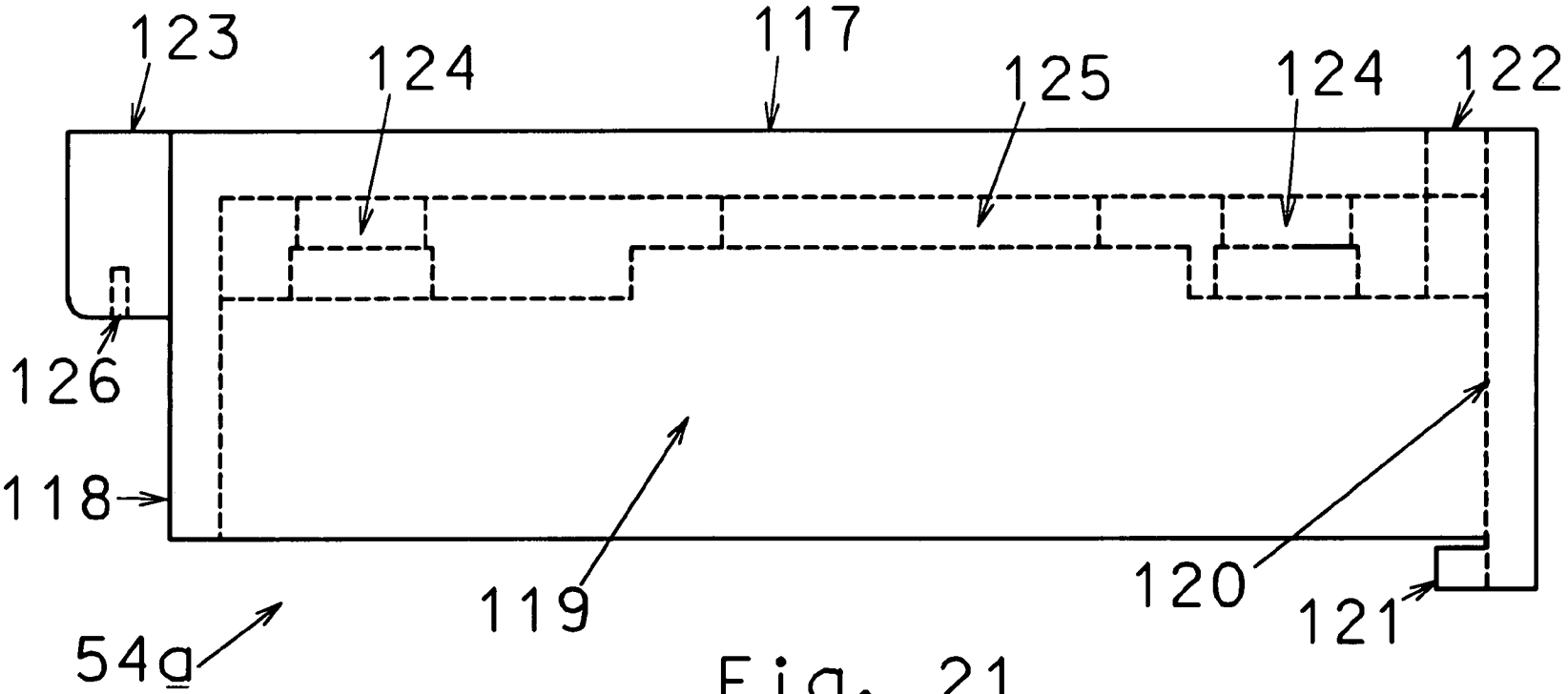

Referring to FIGS. 19, 20 and 21, a foot pump top portion 54*a* has a top plate 117, a front wall 118, two side walls 119, a back wall 120, many stoppers 121, many stopper construction slots 122, a belt mounting plate 123, many spring resting holes 124, a bellow resting hole 125, and a belt anchoring hole 126. Basically, the foot pump top portion is an open box with the top plate 117, the front wall 118, the two side walls 119 and the back wall 120 as its side walls. The stoppers 121 and the belt mounting plate 123 are objects protruding from the back wall 120 and the front wall 118, respectively. The stopper construction slots 122 are slots on the top plate 117 so that the foot pump top portion can be molded to have the stoppers 121. The spring resting holes 124 and the bellow resting hole 125 are depressed areas on the interior surface of the top plate 117. The belt anchoring hole 126 is a hole for a screw on the belt mounting plate 123.

Figure 22:
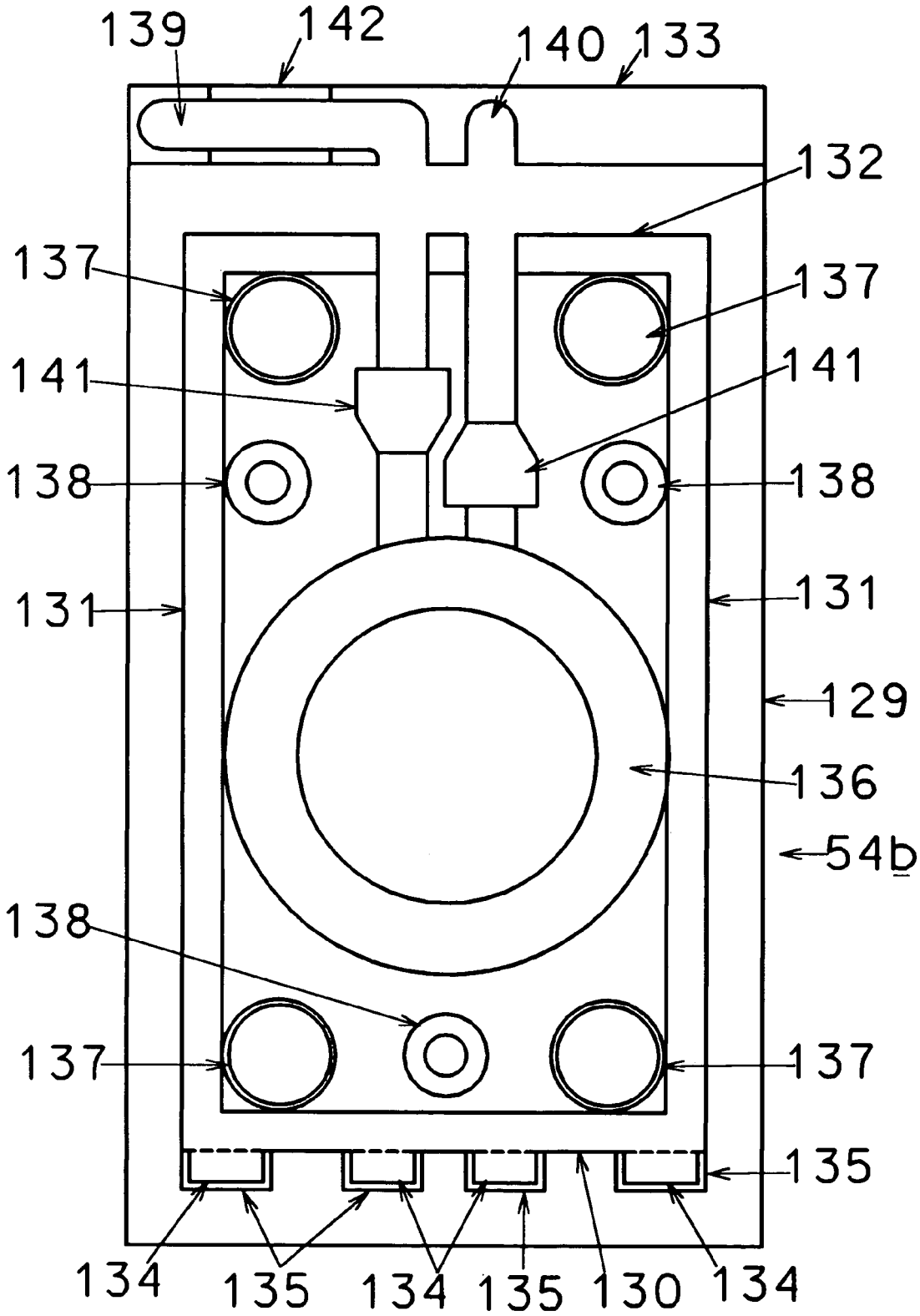
FIGS. 22, 23 and 24 are a top view, an elevation view and a side view, respectively, of the "foot pump bottom portion" component of the invented device.
Figure 23:
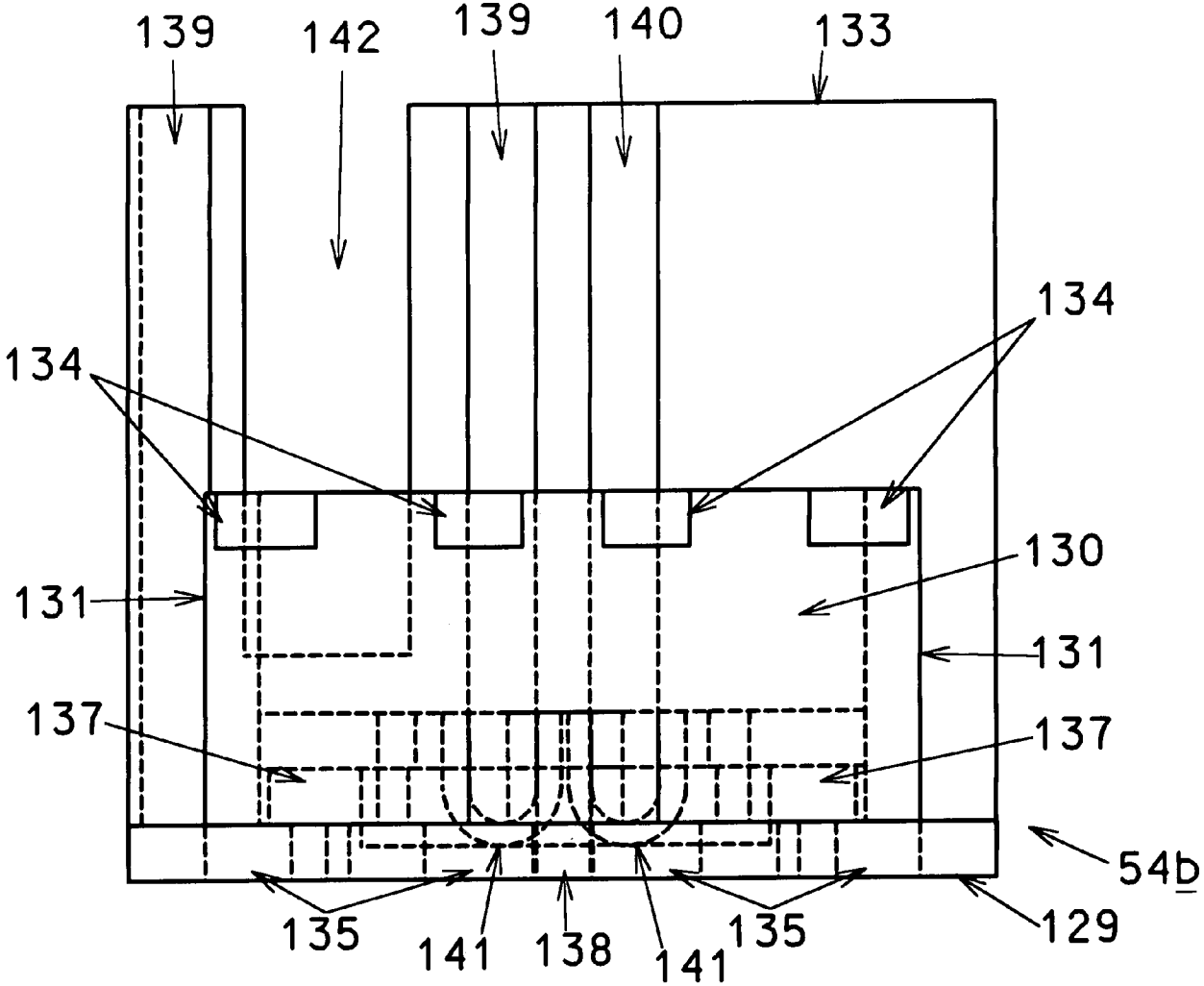
Figure 24:
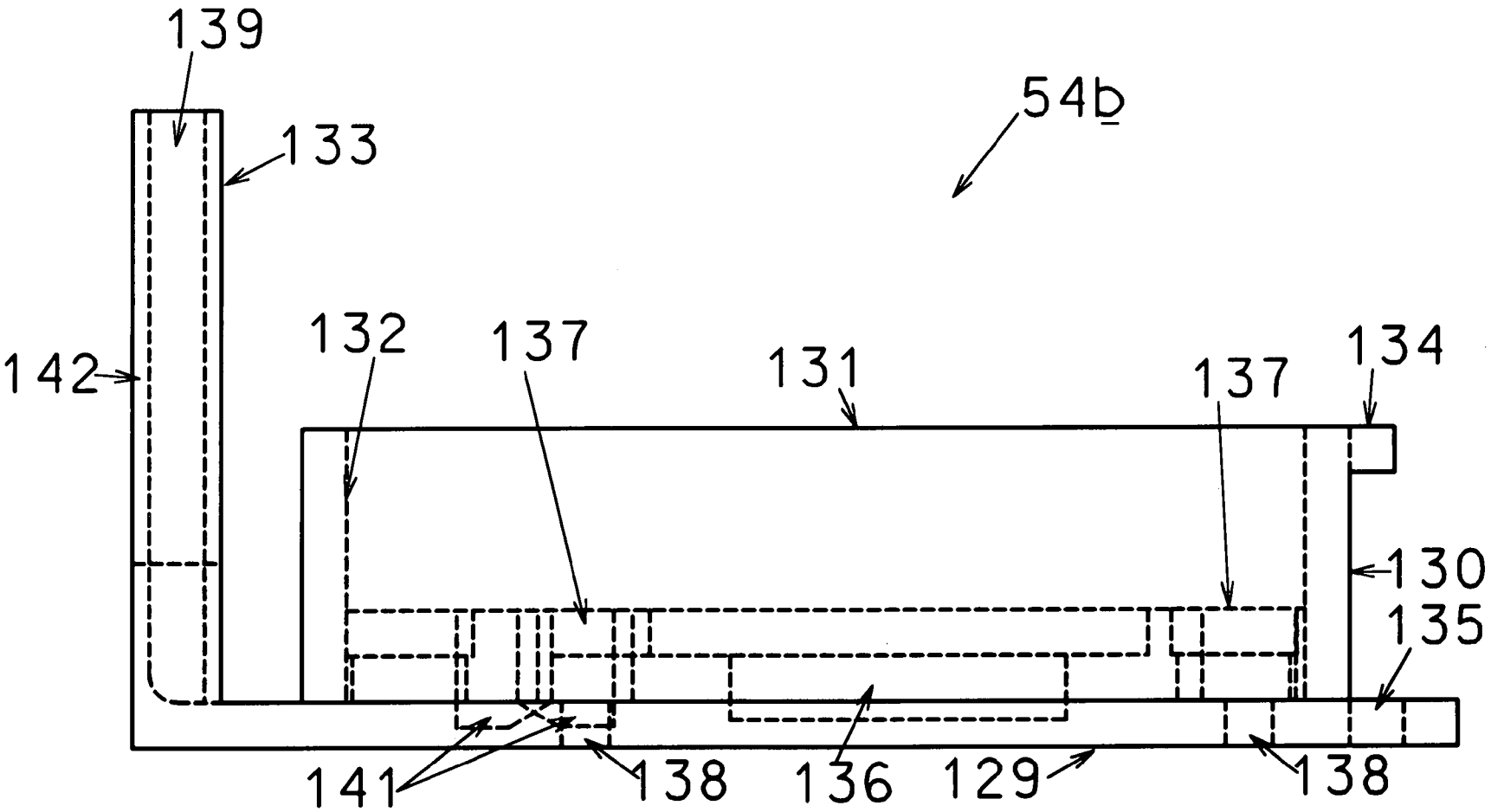

Referring to FIGS. 22, 23 and 24, a foot pump bottom portion 54*b* has a bottom plate 129, a end wall 130, two side walls 131, a middle wall 132, a tube wall 133, many stoppers 134, many stopper construction slots 135, a bellow resting hole 136, many spring resting holes 137, many anchoring bolt holes 138, a supply tube 139, slot a return tube slot 140, two check valve slots 141, and a belt mounting plate slot 142. Similar to the foot pump top portion, the foot pump bottom portion basically is an open box with the bottom plate 129, the end wall 130, the two side walls 131 and the middle wall 132 as its side walls. The tube wall 133 is another wall beyond the middle wall 132. The stoppers 134 are objects protruding from the end wall 130. The stopper construction slots 135 are slots on the bottom plate 129 so that the foot pump bottom portion can be molded to have the stoppers 134. The spring resting holes 137, the bellow resting hole 136 and the two check valve slots 141 are depressed areas on the interior surface of the bottom plate 129. The anchoring bolt holes 138 are holes on the bottom plate for bolts to anchor the foot pump bottom portion on a floor. The supply tube slot 139, the return tube slot 140, and the belt mounting plate slot 142 are holes or slots on the tube wall 133.

Figure 25:
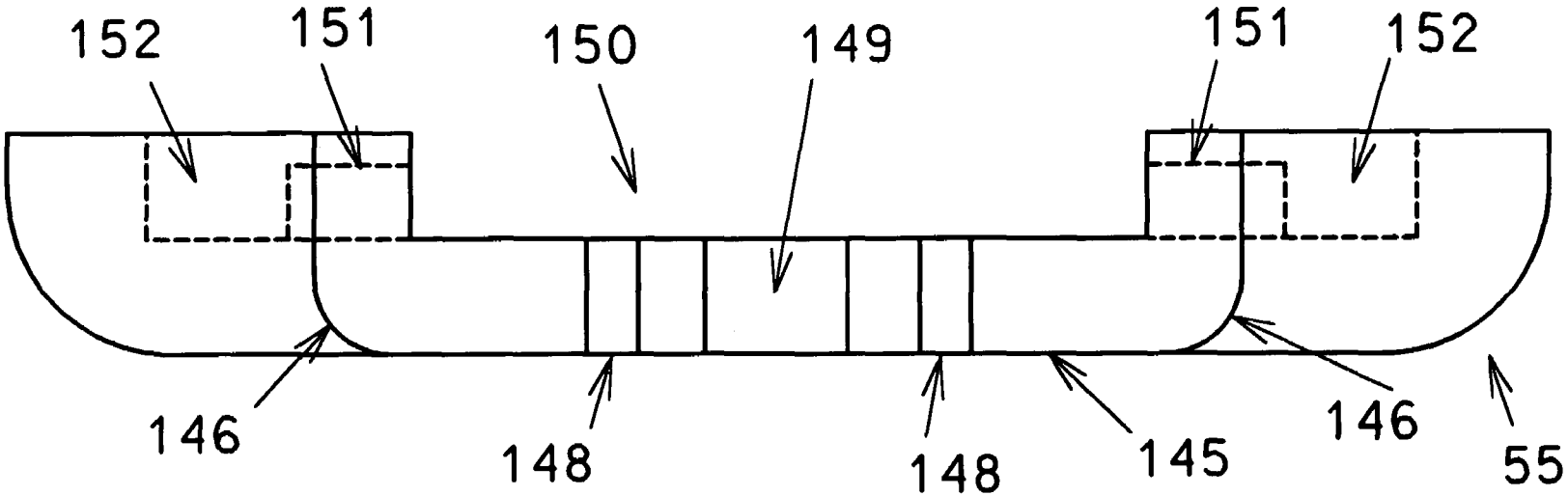
FIGS. 25, 26 and 27 are a top view, an elevation view and a side view, respectively, of the "conduit cover" component of the invented device.
Figure 27:
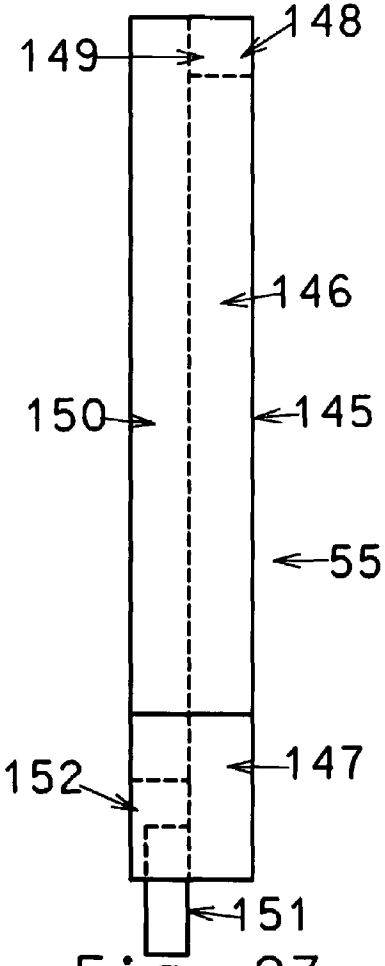
Figure 26:
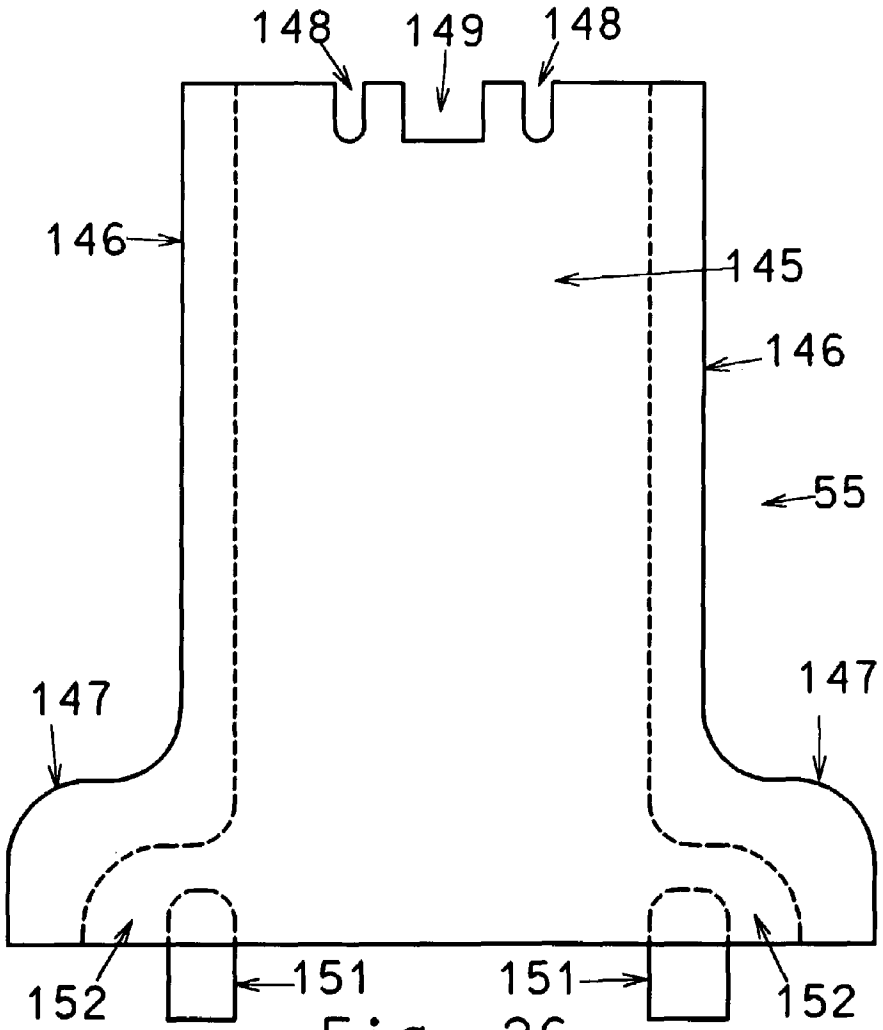

Referring to FIGS. 25, 26 and 27, the conduit cover 55 consists of a front wall 145, two side walls 146, two footings 147, two anchoring slots 148, an existing drain pipe slot 149, a tubes/belts opening 150, two anchoring inserts 151, and two tube slots 152. The conduit cover resembles a flat channel with the front wall 145 and the two side walls 146 as the channel walls and the tubes/belts opening 150 as the channel itself. One end of the channel is widened to become the two footings 147. The two anchoring slots 148 and the existing drain pipe slot 149 are slots on the top edge of the front wall 145. The two anchoring inserts 151 are two protruding objects at the bottom edge of the front wall 145. The two tube slots 152 are two channels between the footings 147 and the anchoring inserts 151. The thickness of the conduit cover 55 is thicker than the combined thickness of the tube wall 133, the middle wall 132 of the foot pump bottom portion 54*b* and the front wall 118 of the foot pump top portion 54*a*.

Figure 28:
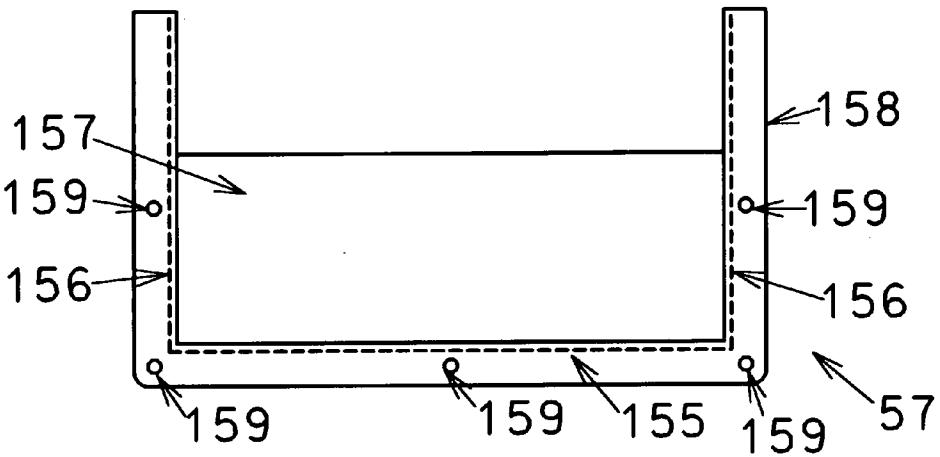
FIGS. 28, 29 and 30 are atop view, an elevation view and a side view, respectively, of the "existing drain cover" component of the invented device.
Figure 29:
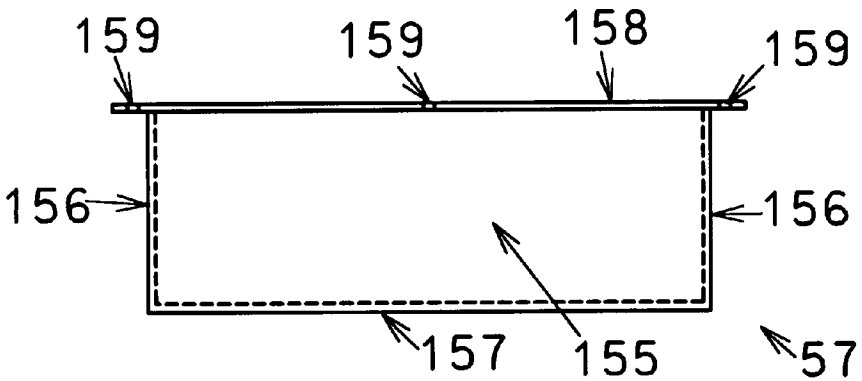
Figure 30:
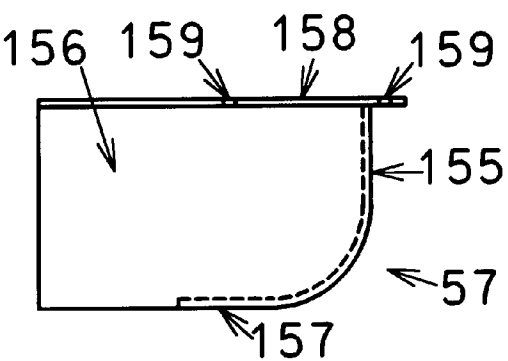

Referring to FIGS. 28, 29 and 30, the existing drain cover 57 basically is hood which consists of a front plate 155, two side plates 156, a bottom plate 157, a rim plate 158 and many anchoring bolt holes 159. The front plate 155, the two side plates 156 and the bottom plate 157 are the walls of the hood. The rim plate 158 is a plate protruding along the rim of the front plate 155 and the side plates 156. The anchoring bolt holes 159 are holes on the rim plate 158.

Figure 31:
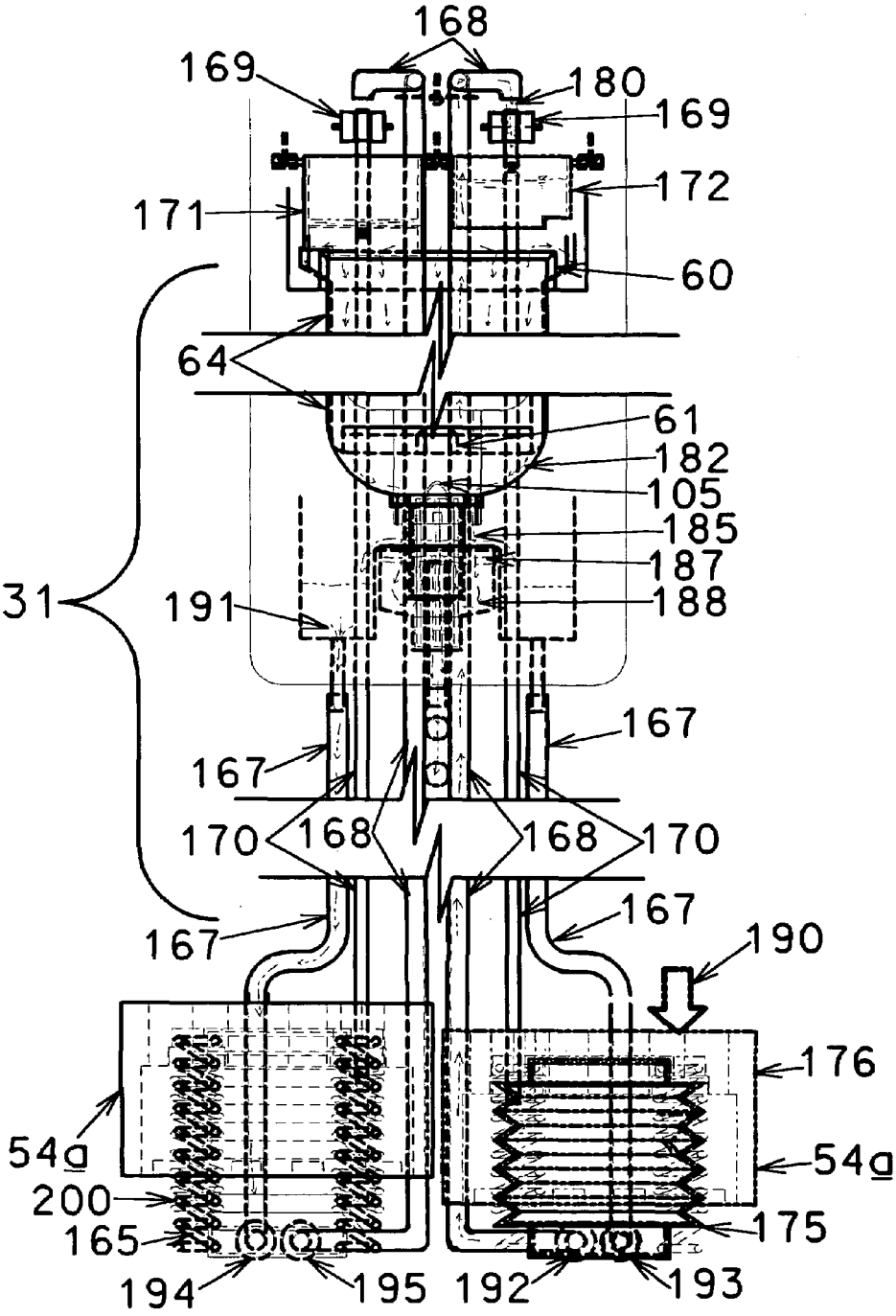
FIGS. 31 and 32 are an elevation view and a side view, respectively, which illustrate the main functions of the invented device.
Figure 32:
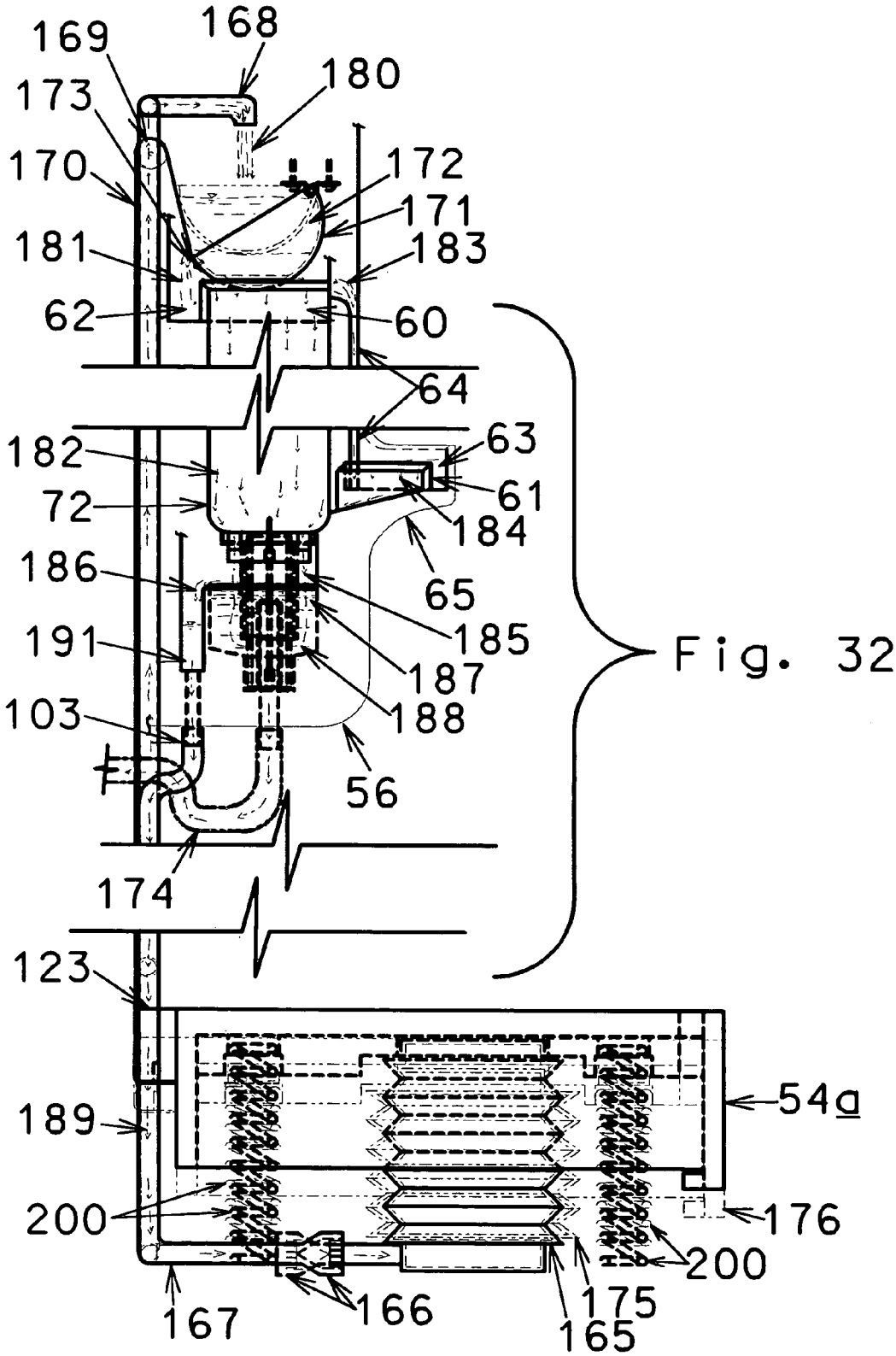

Referring to FIGS. 31 and 32, each of the piping/control/holding systems consists of a bellow (165 in expanded position and 175 in compressed position), many springs (not all shown but some of them can be seen as 200), two check valves 166, a flushing liquid return tube 167, a flushing liquid supply tube 168, a pulley 169, a belt 170, and a bucket (171 in draining position, 172 in filling position). The bellow has two openings which connect with the check valves and with the flushing liquid return tube and the flushing liquid supply tube. The bucket can be pivoted on a mounting device on one end. The other end of the bucket connects with the belt 170 which the other end connects with the belt mounting plate 123 of the foot pump top portion 54*a*. The other end of the flushing liquid return tube 167 connect with the return tube/drain pipe connection 103.

Referring to FIGS. 1 through 32, in constructions of the invented device, a pair of the foot pump bottom portions 54*b* are anchored on the floor near the existing drain 174 by using anchoring bolts (not shown) through the anchoring bolt holes 138. Then, the bellows will be connected with the check valves and the tubes. Then, one end of the bellows, the check valves 166, the flushing liquid return tubes 167, and the flushing liquid supply tubes 168 will be inserted/put on the bellow resting holes 136, the check valve slots 141, the return tube slots 140, and the supply tube slots 139, respectively. One end of the springs will be inserted/put into the spring resting holes 137. The belts 170 will be connected with the belt mounting plate 123 of the foot pump top portion 54*a* by screws through the belt anchoring holes 126. The foot pump top portions will then be placed on top of the foot pump bottom portions with one ends of the bellows and the springs in the bellow resting holes 125 and the spring resting holes 124, respectively, and with the stoppers 121 of the foot pump top portions below the stoppers 134 of the foot pump bottom portions. The belt mounting plates 123 of the foot pump top portions will be in the belt mounting plate slots 142 of the foot pump bottom portions. The front walls of the foot pump top portions will be in the slots between the middles walls 132 and the tube walls 133 of the foot pump bottom portions. The side walls 119 and the back walls 120 of the foot pump top portions will be on the exterior sides of the side walls 131 and the end walls 130 of the foot pump bottom portions. Then, at the receiving base 56, the supply tubes 168 will be inserted through the supply tube holes 93; the lower end of the urine outlet pipe 98 be connected with the existing drain 174; and the belts 170 through the belt rooms 95. The receiving base 56 then will be anchored on the wall (not shown) by anchoring bolts (not shown) though the mounting slots 104 of the wall mounting plate 102. The free ends of the flushing liquid return tubes will be connected with the return tube/drain pipe connections 103 of the receiving base. Then the body 52 will be put on top of the receiving base with the receiving base protrusion 91 engaging with the receiving base recess 77; the body support 92 contacting the receiving base connection wall 78; the urine separator curtain 74 inside the flushing liquid/urine chamber 100; the flushing liquid supply tubes 168 penetrating through the supply tube holes 67; and the belts 170 through the belt rooms 76. The body 52 then will be mounted by anchoring bolts (not shown) through the anchoring notches 68 and 69 to the wall (not shown). With the belts 170 being over the pulleys 169 which are put inside the pulley holes 66, the ends of the belts being connected to the buckets, the buckets being mounted on the bucket mounting supports 86 by screws (shown in FIGS. 4, 5, 6, 31 and 32) through the bucket mounting holes 87, and the end portions of the flushing liquid supply tubes 168 being in the supply tube channels 90 and being anchored by a screw and a clamp through the supply tube mounting hole 88, the cover 53 will be put on top of the body 52 with the cover support beams 85 inside the cover receiver recesses 70, the cover supports 71 contacting the bottom of the cover, and the cover front 84 facing front. Then, the conduit cover 55 will be anchored on the wall by anchoring bolts (not shown) through the anchoring slots 148 with the existing drain 174 penetrating through the existing drain pipe slot 149, the anchoring inserts 151 being inserted insides of the top portions of the supply tube slots 139 (between 142 and 140, FIG. 23) of the foot pump bottom portions 54*b*, portions of the flushing liquid return tubes being inside the tube slots 152, and the flushing liquid return tubes and the flushing liquid supply tubes and the belts being through the tubes/belts opening 150. Then the existing drain cover 57 will be mounted on the bottom of the receiving base 56 by screws (shown in FIGS. 4, 5 and 6 only) through the anchoring bolt holes 159 and the existing drain cover mounting holes 101. The drain unit 105 will be inserted into the drain hole 73 of the body 52 with the edge of the top plate 108 resting on the drain unit support 80 and the bottom of the top plate 108 sealing the top of the urine separator curtain 74. The invented device is then constructed.

Before using the invented device, adequate amount of flushing liquid, which is basically oil with disinfection chemicals, has to be stored inside the flushing liquid/urine chamber 100, the bellows 165 and the flushing liquid chamber 97. The storage can be achieved by firstly pouring freshwater onto the drain unit 105. The freshwater then passes through the drain slots 106 of the drain unit 105 into the flushing liquid/urine chamber 100. The water level in the flushing liquid/urine chamber will reach the rim of the urine outlet pipe 98. Any additional freshwater will be drained through the urine outlet pipe into the existing drain 174. Then adequate amount of the flushing liquid will be poured onto the drain unit. The flushing liquid firstly will fill up the remaining portion of the flushing liquid/urine chamber then flow over the flushing liquid controlling weir 96 into the flushing liquid chamber 97. The flushing liquid in the flushing liquid/urine chamber will float above the freshwater because the flushing liquid is mostly oil which is lighter than the freshwater. The filler of the flushing liquid can press and release the foot pump top portions 54*a* which in turns compresses and releases the bellows and causes the bellows to be filled with adequate amount of the flushing liquid. Then, the invented device is ready to use.

Referring to FIGS. 31 and 32 for the current and three subsequent paragraphs, when using the invented device, the user firstly steps on the foot pump top portions 54*a*. Because of his weight, the foot pump top portions will be pushed downward (190, FIG. 31). The flushing liquid in the bellows will be squeeze out. Because of the check valves 166 which control the directions of flushing liquid flows, the flushing liquid will not be squeezed back into the flushing liquid chambers but into the flushing liquid supply tube 168 then out into the bucket 171 (the bucket in down positions). The downward motions of the foot pump top portions will simultaneously pull down the belts 170 which will pull up the bucket 172 (the bucket in up positions) to allow the buckets to hold additional flushing liquid and to be filled.

The flush wall 72 will take the urine flow of the user. The urine will flow downwards, passing through the drain slots of the drain unit then enter into the flushing liquid/urine chamber (referring to 182, 185 and 188). Because the urine is heavier than the flushing liquid, urine will sink below the flushing liquid (referring to 187). Urine will flow into the urine outlet pipe but will not flow over the flushing liquid controlling weir because the crest elevation of the flushing liquid controlling weir is higher than the rim of the urine outlet pipe. A layer (referring to 187) of the flushing liquid will always float above the urine in the flushing liquid/urine chamber. With the bottom of the drain unit sealing the top rim of the urine separator curtain and the flushing liquid floating above the urine, the urine in the flushing liquid/urine chamber will be positively sealed to the atmosphere above.

After the user's foot leaves a foot pump top portion, the springs in the foot pump will push up the foot pump top portion which in turn allows the bellow to expand and the belt 170 to rise. The rise of the belt will result in the lowering of one edge of the bucket 171 which will release its stored flushing liquid into the high channel 62 (referring to 181). As the bucket is sized to contain more liquid than the high channel can hold, the flushing liquid will overflow the high weir 60 and will flow downward to flush most portions of the flush wall 72. Some flushing liquid will enter the connection channel 64 then into the low channel 63 (referring to 183). The low channel will be sized that overflow from the low weir 61 can occur. The overflow will flush a portion of the flush wall 72. The flushing liquid after flushing the flush wall 72 will enter the flushing liquid/urine chamber 100 (referring to 182, 185 and 188). Then, heavy liquid such as urine residuals will drop below the flushing liquid layer and eventually drain into the urine outlet pipe 98. The excess amount of the flushing liquid will overflow the flushing liquid controlling weir 96 into the flushing liquid chamber 97 (referring to 186).

The expansion of the bellow and the existence of the check valves, the bellow will suck back some of the liquid which is in the flushing liquid chamber (referring to 189 and 191). Because of the existence of the check valves, only the liquid in the flushing liquid chamber can be sucked into the bellow. After the user's foot leaves a foot pump top portion, The bellow will be refilled with the flushing liquid again and the invented device is ready for the next user. Because the flushing liquid contains the disinfection chemicals, the next user can have a sanitized urinal to use.

Figure 33:
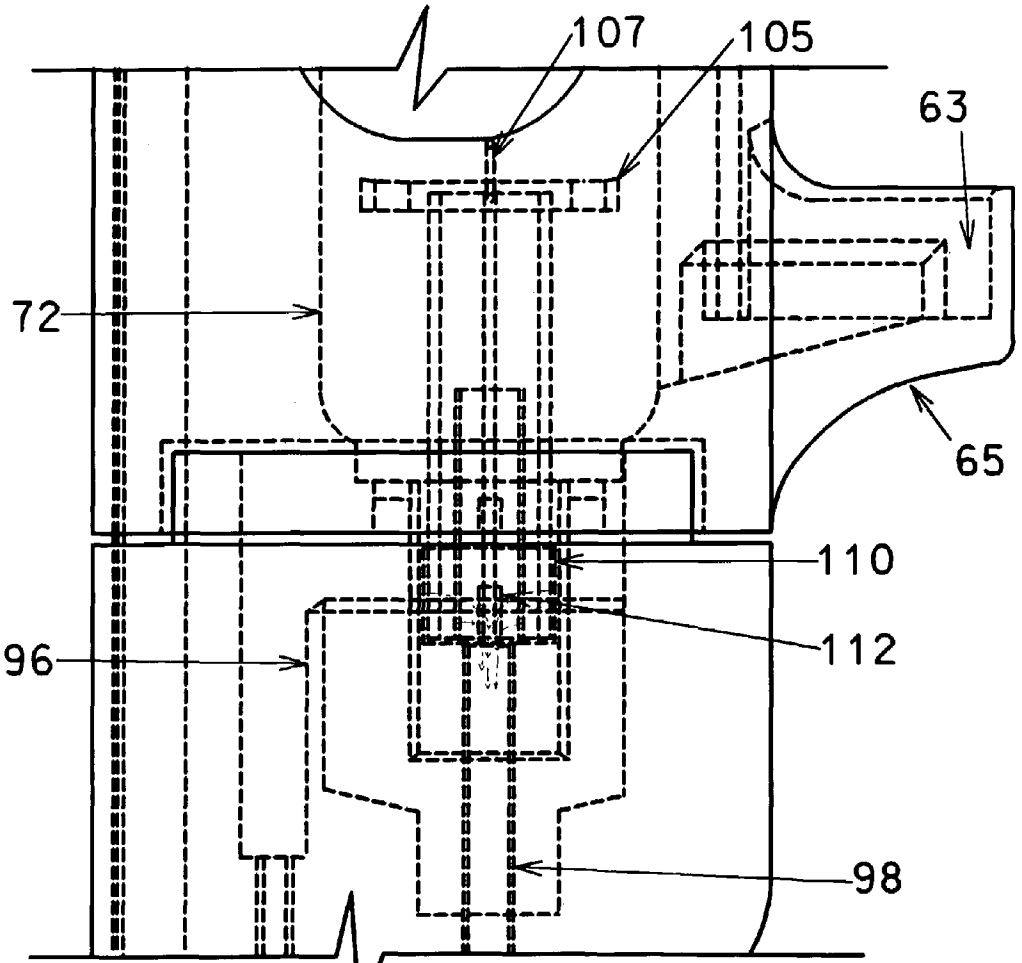
FIG. 33 is a side view that illustrates the use of the "drain unit" component of the invented device. The "drain unit" component is shown in a pulled-up position.

The heavy residuals that can not be carried up from the flushing liquid/urine chamber to be drained by the urine outlet pipe will settle to the bottom of the flushing liquid/urine chamber. Because the sloped bottom of the flushing liquid/urine chamber, the heavy residuals will eventually settle into the debris basket which is in the drain unit chamber. Referring to FIG. 33, to clean the heavy residuals out a maintenance worker needs to pull upwards the drain unit 105 by the lifting eye 107. Because the heavy residuals are confined in the space between the debris basket bottom plate, the debris basket inner wall, the debris basket outer wall 110 and the urine outlet pipe 98, the heavy debris will be pulled up. When the debris basket drain slots 112 is above the rim of the urine outlet pipe 98, the heavy residuals will start to drain out of the confined space and into the urine outlet pipe. The heavy residuals then can be removed from the invented device. The maintenance worker needs to reinsert the drain unit back to its original location then the device is ready for use again.

Figure 34:
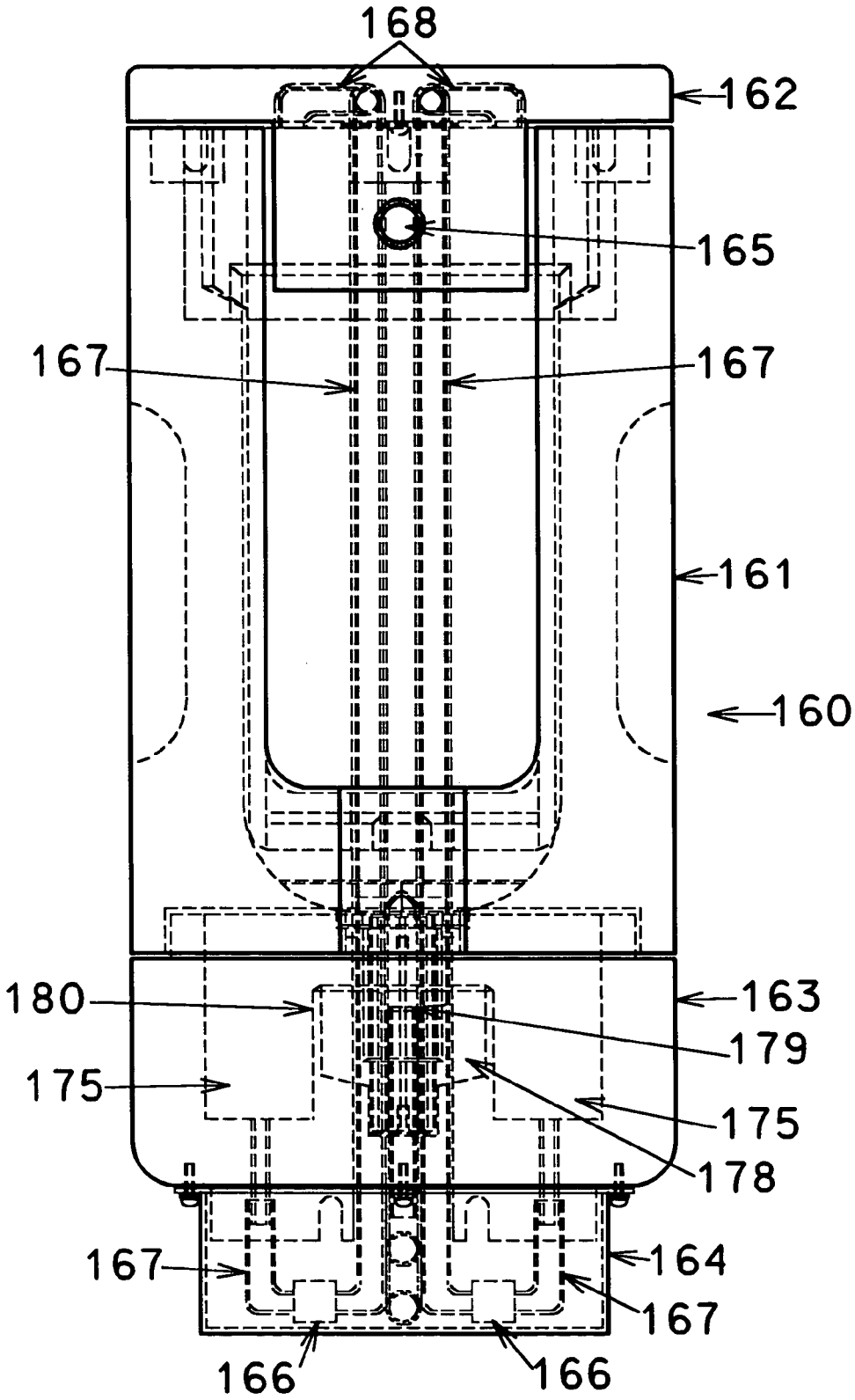
FIGS. 34 and 35 are an elevation view and a side view, respectively, of the other variation of the invented device.
Figure 35:
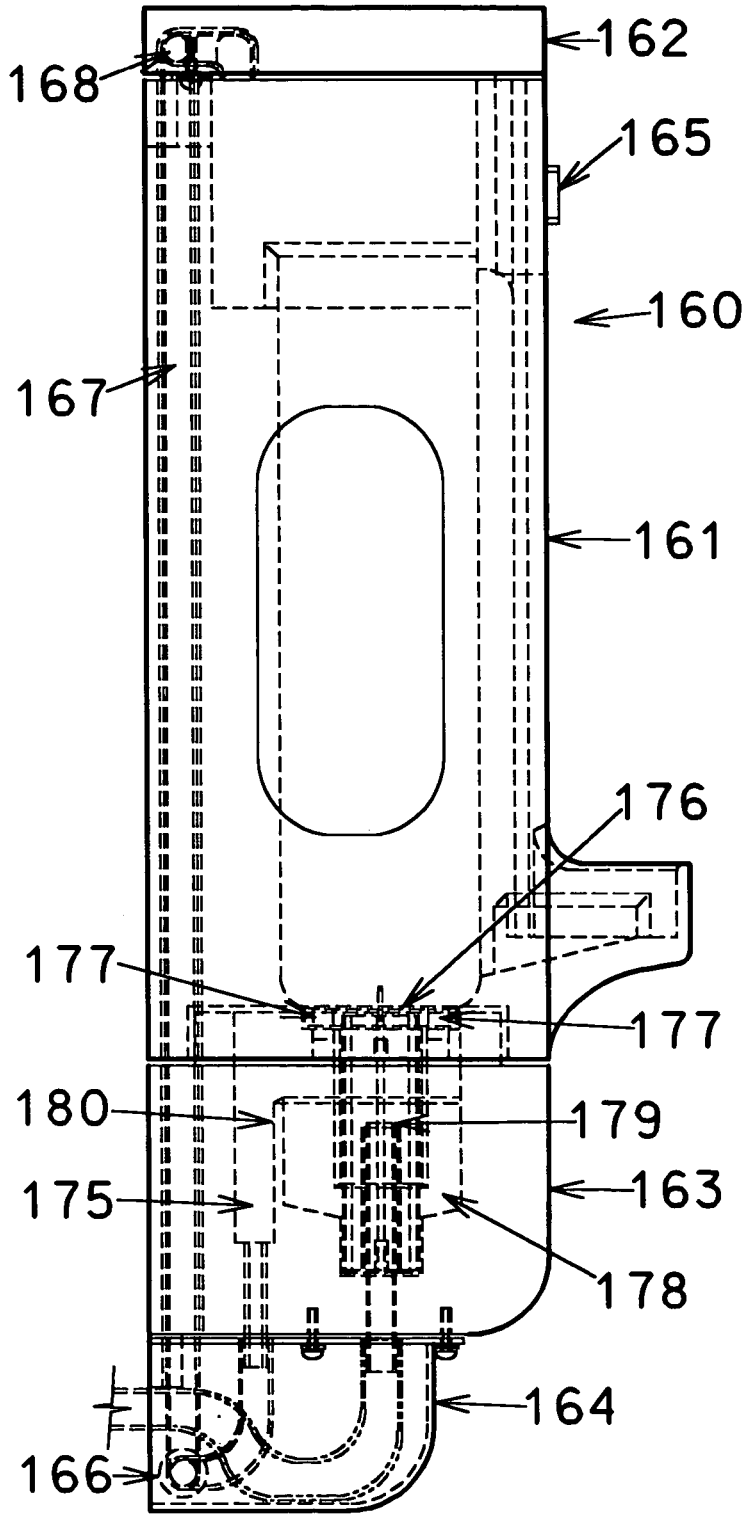

Referring to FIGS. 34 and 35, the second variation of the invented waterless urinals which can be flushed 160 consists of a body 161, a cover 162, a receiving base 163, an existing drain cover 164, a piping/control system, a sensing and signal device 165, two pump and motors 166, a piping system 167, and wires (not shown).

The body 161, the cover 162, the receiving base 163, and the existing drain cover 164 are similar to those for the first variation of the invented devices with the exceptions that the body 161 and the receiving base 163 may optionally not have the belt room 76, the pulley hole 66, and the belt room 95 (referring to FIGS. 7, and 13, respectively), the cover may not have the covert support beam 85 and the bucket mounting supports 86 (referring to FIG. 10), and the existing drain cover 164 has a large bottom plate and may optionally have rounded edges. Their components share the same names as those described for the first variation of the invented devices. However, the cover 162 does have the sensing and signal device 165 in the cover front 84 (referring to FIG. 10). The sensing and signal device 165 can detect the existence of a user in front of the invented devices. The sensing and signal device also can send out signals when there is some malfunctions in the invented devices. In this variation, the piping system 167 connects the flushing liquid chamber 175 of the body 161 to the pump and motor 166 then to the cover 162. The pump and motor 166 has a sensor (not shown) which can detect the existence of liquid in the flushing liquid chamber. The wires (not shown) will provide electricity and control signals to the invented devices. The signals from the sensing and signal device 165 will control the pump and motor 166.

The construction of this second variation of the invented device is similar to that of the first variation's except that the second variation of the invented device does not have the components below the existing drain cover. In the construction, the lower end of the urine outlet pipe of the receiving base will be connected with an existing drain firstly. Then the receiving base will be anchored on the wall by anchoring bolts though the mounting slots of the wall mounting plate of the receiving base. The free ends of the flushing liquid return tubes will be connected with the return tube/drain pipe connections of the receiving base. Then the body will be put on top of the receiving base with the receiving base protrusion engaging with the receiving base recess; the body support contacting the receiving base connection wall; the urine separator curtain inside the flushing liquid/urine chamber; and the flushing liquid supply tubes penetrating through the supply tube holes. The body then will be mounted by anchoring bolts through the anchoring notches to the wall. Then, the end portions of the flushing liquid supply tubes will be inserted in the supply tube channels and be anchored by a screw and a clamp through the supply tube mounting hole. The cover will be put on top of the body. The sensing and signal devices and the power supplies will be mounted. Then the existing drain cover will be mounted on the bottom of the receiving base by screws through the anchoring bolt holes and the existing drain cover mounting holes. The existing drain cover will hold the pump and motors. The drain unit will then be inserted into the drain hole of the body with the edge of the top plate resting on the drain unit support and the bottom of the top plate sealing the top of the urine separator curtain. The invented device is then constructed.

Before using the invented device, adequate amount of flushing liquid has to be stored inside the flushing liquid chamber 175. The storage can be achieved by firstly disconnecting the electricity supply to the invented devices then pouring freshwater onto the drain unit 176. The freshwater then passes through the drain slots 177 of the drain unit into the flushing liquid/urine chamber 178. The water level in the flushing liquid/urine chamber will reach the rim of the urine outlet pipe 179. Any additional freshwater will be drained through the urine outlet pipe into the existing drain. Then adequate amount of the flushing liquid will be poured onto the drain unit. The flushing liquid firstly will fill up the remaining portion of the flushing liquid/urine chamber then flow over the flushing liquid controlling weir 180 into the flushing liquid chamber 175. Then, the electricity supply will be connected to the invented device and the is ready to use.

Referring to FIGS. 34 and 35, when the electricity supply is on, the sensor of the pump and motor 166 detects the existence of liquid in the flushing liquid chamber and the signals from the sensing and signal device 165 indicating a user is leaving, the pump and motors 166 will start sucking the flushing liquid from the flushing liquid chamber 175 then pump the flushing liquid up through the piping system 167 into the high channel. When the high channel is full, overflowing from the high channel will start the flushing work. The flushing liquid will overflow the high weir and will flow downward to flush the flush wall. Some flushing liquid will enter the connection channel into the low channel. The low channel will be sized that overflow from the low weir can occur. The overflow will flush the flush wall. The flushing liquid after flushing the flush wall will enter the flushing liquid/urine chamber. Then, heavy liquid such as urine will drop below the flushing liquid layer and eventually drain into the urine outlet pipe. The excess amount of the flushing liquid will overflow the flushing liquid controlling weir into the flushing liquid chamber. The pump and motors 166 will stop working automatically after passing a preset period of time.

Like the first variation of the invented devices, the flush wall will take the urine flow of the user. The urine will flow downwards, passing through the drain slots of the drain unit then enter into the flushing liquid/urine chamber. Because the urine is heavier than the flushing liquid, urine will sink below the flushing liquid. Urine will flow into the urine outlet pipe but will not flow over the flushing liquid controlling weir because the crest elevation of the flushing liquid controlling weir is higher than the rim of the urine outlet pipe. A layer of the flushing liquid will always float above the urine in the flushing liquid/urine chamber. With the bottom of the drain unit sealing the top rim of the urine separator curtain and the flushing liquid floating above the urine, the urine in the flushing liquid/urine chamber will be positively sealed to the atmosphere above.

The heavy residuals can be removed in the same way as this described for the first variation of the invented devices.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, falling within the scope of the invention as claimed.

I claim:

1. A waterless urinal that can be flushed with liquid consists of:

a) a body and a flushing liquid recycling system;

b) said body having an interior surface which can receive urine;

c) said interior surface having a drain hole which has a urine separator curtain which is substantially a short conduit;

d) said interior surface having a drain unit which has a perforated surface and a bucket which bottom has a hole;

e) said perforated surface of said drain unit being able to rest on said drain hole;

f) said bucket of said drain unit being able to be inserted inside said urine separator curtain;

g) said interior surface having a mean to receive, convey, and spread liquid on a portion of said interior surface;

h) said body having a cover which is on the top of said body;

i) said body having a base which has a flushing liquid chamber, a flushing liquid controlling weir, a flushing liquid/urine chamber, a urine outlet pipe, and a drain unit chamber;

j) said flushing liquid chamber and said flushing liquid/urine chamber being spaces which are separated by said flushing liquid controlling weir which is a relatively tall dividing wall;

k) said drain unit chamber being a depressed area in said flushing liquid/urine chamber;

l) said urine outlet pipe being a pipe protruding above said drain unit chamber at one end and being able to be connected with a urine collection system such as a sewer pipe at the other end;

m) said bucket of said drain unit of said interior surface being able to rest in said drain unit chamber with said urine outlet pipe penetrating said hole of said bucket of said drain unit;

n) the bottom rim of said urine separator curtain being inside said flushing liquid/urine chamber and being lower than the crest of said flushing liquid controlling weir;

o) the top rim of said urine outlet pipe being lower than the crest of said flushing liquid controlling weir but being higher than the bottom rim of said urine separator curtain;

p) said flushing liquid recycling system having a self-returning peddle system, a pumping system, and a bucket system;

q) said bucket system having a bucket control mean and a bucket under said cover of said body;

r) said bucket being able to be tilted in an relatively up position to hold liquid and to be tilted in a relatively down position to drain liquid;

s) said pumping system being a foot-operated positive displacement pump system which has a compressible chamber such as a bellow and a pipe/valve system which can convey and control liquid flows;

t) said pumping system being able to suck liquid from said flushing liquid chamber then send said liquid to said bucket of said bucket system;

u) said self-returning peddle system consisting of a lower platform and an upper platform with springs in between;

v) said compressible chamber of said pumping system being sandwiched by said upper platform and said lower platform of said self-returning peddle system which, when being compressed or uncompressed, can compress and uncompress said compressible chamber;

w) said bucket control mean being a linking system which one end is connected with said bucket of said bucket system and the other end is connected with said upper platform of said self-returning peddle system;

x) said self-returning peddle system being below said body.

2. A waterless urinal that can be flushed with liquid of claim 1 in which said mean to receive, convey, and spread liquid on a portion of said interior surface consists of a channel system which has a side wall that can work as a weir to spread liquid.

3. A waterless urinal that can be flushed with liquid of claim 1 which has a cover under said body to cover and hide said urine collection system such as a sewer pipe.

4. A waterless urinal that can be flushed with liquid of claim 1 which has a cover between said body and said self-returning peddle system to cover and hide a portion of said pipe/valve system.

5. A waterless urinal that can be flushed with liquid of claim 1 which said main body has a protruding portion that can receive urine.

6. A waterless urinal that can be flushed with liquid of claim 2 which said channel has at least one outlet which connects to a conduit that connects to a relatively low channel system which one side wall functions as a weir to spread liquid.

7. A waterless urinal that can be flushed with liquid of claim 1 which said drain unit has a lifting mean such as a lifting eye.

8. A waterless urinal that can be flushed with liquid of claim 1 which said bucket control mean consists of a pulley and a string.

9. A waterless urinal that can be flushed with liquid of claim 1 which said bucket control mean consists of a lever and a string.

10. A waterless urinal that can be flushed with liquid of claim 1 which said pipe/valve system has two one-way valves.

11. A waterless urinal that can be flushed with liquid of claim 1 which has dual said flushing liquid recycling system.

12. A waterless urinal that can be flushed with liquid consists of:

a) a body and a flushing liquid recycling system;
b) said body having an interior surface which can receive urine;
c) said interior surface having a drain hole which has a urine separator curtain which is substantially a short conduit
d) said interior surface having a drain unit which has a perforated surface and a bucket which bottom has a hole;
e) said perforated surface of said drain unit being able to rest on said drain hole;
f) said bucket of said drain unit being able to be inserted inside said urine separator curtain;
g) said interior surface having a mean to receive, convey, and spread liquid on a portion of said interior surface;
h) said body having a cover which is on the top of said body;
i) said body having a base which has a flushing liquid chamber, a flushing liquid controlling weir, a flushing liquid/urine chamber, a urine outlet pipe, and a drain unit chamber;
j) said flushing liquid chamber and said flushing liquid/urine chamber being spaces which are separated by said flushing liquid controlling weir which is a relatively tall dividing wall;
k) said drain unit chamber being a depressed area in said flushing liquid/urine chamber;
l) said urine outlet pipe being a pipe protruding above said drain unit chamber at one end and being able to be connected with a urine collection system such as a sewer pipe at the other end;
m) said bucket of said drain unit of said interior surface being able to rest in said drain unit chamber with said urine outlet pipe penetrating said hole of said bucket of said drain unit;
n) the bottom rim of said urine separator curtain being inside said flushing liquid/urine chamber and being lower than the crest of said flushing liquid controlling weir;
o) the top rim of said urine outlet pipe being lower than the crest of said flushing liquid controlling weir but being higher than the bottom rim of said urine separator curtain;
p) said flushing liquid recycling system having a pumping system and a power switch system which controls and operates said pumping system;
q) said pumping system being able to suck liquid from said flushing liquid chamber then send said liquid to said mean to receive, convey, and spread liquid on a portion of said interior surface of said body.

13. A waterless urinal that can be flushed with liquid of claim 12 in which said mean to receive, convey, and spread liquid on a portion of said interior surface consists of a channel system which has a side wall that can work as a weir to spread liquid.

14. A waterless urinal that can be flushed with liquid of claim 12 which has a cover under said body to cover and hide said urine collection system such as a sewer pipe.

15. A waterless urinal that can be flushed with liquid of claim 12 which said main body has a protruding portion that can receive urine.

16. A waterless urinal that can be flushed with liquid of claim 13 which said channel has at least one outlet which connects to a conduit that connects to a relatively low channel system which side wall functions as a weir to spread liquid.

17. A waterless urinal that can be flushed with liquid of claim 12 which said drain unit has a lifting mean such as a lifting eye.

18. A waterless urinal that can be flushed with liquid of claim 12 which said pumping system has a pump/motor/piping/power supply system which provides powers and flow controls to recycle said liquid.

19. A waterless urinal that can be flushed with liquid of claim 12 which power switch system has a sensor system that can detect the existence of liquid in said flushing liquid chamber.

20. A waterless urinal that can be flushed with liquid of claim 12 that said power switch system is a switch that can control power supplies to said pumping system.

21. A waterless urinal that can be flushed with liquid of claim 12 that said power switch system has a sensor that can detect the arriving/leaving of a user to turn on said flushing liquid system.

22. A waterless urinal that can be flushed with liquid of claim 12 which said power switch system has a timer which can turn off power to said pumping system after passing of a pre-set time limit.

23. A waterless urinal that can be flushed with liquid of claim 12 which has dual said pumping system of said flushing liquid recycling system.

24. A waterless urinal that can be flushed with liquid consists of a urinal which has a flushing liquid and urine separator and a flushing liquid recycling system; said flushing liquid and urine separator having three flow barriers which can guide urine to down-and-up type flow paths to a drain; two of said three flow barriers being able to serve as weirs; said flushing liquid recycling system being able to send flushing liquid from the lower portion of said urinal to the upper portion of said urinal.

25. A waterless urinal that can be flushed with liquid of claim 24 which said flushing liquid recycling system is a foot-operated pumping system.

26. A waterless urinal that can be flushed with liquid of claim 25 which said foot-operated pumping system of said flushing liquid recycling system has a paddle which connects to a bucket which can be tilted up or down by operations of said paddle.

27. A waterless urinal that can be flushed with liquid of claim 25 which said foot-operated pumping system of said flushing liquid recycling system has two paddles which connect to two buckets which can be tilted up or down by operations of said two paddles.

28. A waterless urinal that can be flushed with liquid of claim 24 which said flushing liquid recycling system is a pump, motor and piping system which has a sensor, switch, timer and power supply system.

* * * * *